US005102761A

United States Patent [19]

Ohsaki et al.

[11] Patent Number: 5,102,761

[45] Date of Patent: Apr. 7, 1992

[54] COLOR TONER FOR ELECTROPHOTOGRAPHY CONTAINING A PHENOLIC COMPOUND

[75] Inventors: Ichiro Ohsaki, Kawasaki; Takaaki Kohtaki, Yokohama; Yuko Sato, Yokohama; Hiroyuki Kobayashi, Yokohama; Toshiyuki Ugai, Tokyo, all of Japan

[73] Assignee: Canon Kabushiki Kaisha, Tokyo, Japan

[21] Appl. No.: 517,191

[22] Filed: May 1, 1990

[30] Foreign Application Priority Data

May 2, 1989 [JP] Japan ..... 1-112229
May 10, 1989 [JP] Japan ..... 1-115004

[51] Int. Cl.[5] ..... G03G 9/09

[52] U.S. Cl. ..... 430/106; 430/109

[58] Field of Search ..... 430/106, 109, 110

[56] References Cited

U.S. PATENT DOCUMENTS 4,933,250 6/1990 Nakayama et al. ..... 430/109
4,950,574 8/1990 Kumagai et al. ..... 430/109

*Primary Examiner*—John Goodrow
*Attorney, Agent, or Firm*—Fitzpatrick, Cella, Harper & Scinto

[57] ABSTRACT

A color toner for developing an electrostatic latent image, which includes a binder resin, a xanthene-type dye and a compound containing a phenolic —OH (hydroxyl) group.

43 Claims, 4 Drawing Sheets

GPC CHART OF POLYMER a

GPC CHART OF RESIN a

GPC CHART OF RESIN A
USING NO POLYMER a

COLOR TONER FOR ELECTROPHOTOGRAPHY CONTAINING A PHENOLIC COMPOUND

FIELD OF THE INVENTION AND RELATED ART

The present invention relates to a color toner to be used in an image forming method such as electrophotography, particularly to a color toner suitable for an image forming apparatus such as full-color or multicolor copying machine using a heat roller fixing device with a silicone rubber roller and/or a roller coated with polytetrafluoroethylene (e.g. Teflon).

In general, a colorant to be used for color toners for electrophotography is required to have various qualities. Specific examples thereof may include such that:

(1) it has a clear or vivid color;

(2) it has good dispersibility in a binder resin and strong coloring (or tinting) power;

(3) it has uniform triboelectric chargeability and the triboelectric chargeability is not substantially deteriorated even under a high temperature-high humidity condition;

(4) it matches with various functions required for an image forming apparatus such as copying machine; and (5) it does not have a side effect (or harmful effect) on an image forming apparatus such as adhesion and dyeing thereof to the surface of a fixing roller.

As the red colorant used for electrophotographic color toners, there have been used quinacridone pigments, thioindigo pigments, xanthene pigments, anthraquinone pigments, monoazo pigments, perylene pigments, etc. For example, Japanese Patent Publication (JP-B, KOKOKU) No. 46951/1974 describes 2,9-dimethylquinacridone, Japanese Laid-Open Patent Application (JP-A, KOKAI) No. 26574/1980 describes thioindigo pigments, and Japanese Laid-Open Patent Application No. 57256/1984 describes xanthene pigments.

Among these colorants, since the xanthene pigments may have a vivid bluish pink color and are excellent in saturation, they have often been used as a colorant for color toners, singly or in combination with a colorant having another color. However, the toner containing the xanthene pigment is liable to contaminate a silicone rubber used in the surface portion of a roller for a heat roller fixing device, since it gradually dyes the silicone rubber roller under successive copying, and it finally causes a so-called "offset phenomenon" such that the toner is fused to a heating roller.

Further, the above-mentioned oil-soluble dyes have a tendency to decrease the triboelectric chargeability of a toner rather than enhance the chargeability. Accordingly, the oil-soluble dye can sufficiently prevent charge-up so as to guarantee a desirable image density under a low temperature - low humidity condition. However, under a high temperature - high humidity condition, the above-mentioned dyes are liable to cause toner scattering due to charging insufficiency, contamination in the copying machine due to toner scattering, and fog in the resultant image due to toner particles having a smaller charge amount. As a result, they are liable to cause image staining.

Japanese Patent Publication No. 47174/1978 proposes a magenta toner to be used in combination with an appropriate binder resin wherein quinacridone-type or rhodamine-type colorants are used as the colorant. However, none of these colorants satisfy all the above-mentioned characteristics (1) to (5) required for the colorant for color toner, but each of them has both merits and demerits.

For example, while the quinacridone-type organic pigment is a high-grade pigments having a somewhat reddish color and good light resistance, it does not exhibit sufficient magenta performances when singly added to a toner. More specifically, with respect to the hue, it provides less reflection corresponding to a blue color and the color thereof deviates to the red color side, as compared with an ideal magenta color. Further, since the quinacridone-type pigment is classified into a pigment, it provides insufficient dispersibility in a binder resin and poor saturation in view of clearness, whereby the resultant vividness becomes insufficient. In other words, when the quinacridone pigment is used singly, it only provides insufficient quality with respect to color reproducibility. On the other hand, when such a pigment is used in a toner, it has an advantage such that carrier contamination is small under repetitive copying.

Japanese Laid-Open Patent Application Nos. 130044/1982 and 130046/1982 propose a magenta toner using two kinds of oil-soluble dyes. This magenta toner has a clear color tone and an excellent saturation, but one of these two kinds of dyes contains a component contaminating silicone rubber to be used in a heat roller fixing device. Accordingly, the magenta toner gradually dyes the silicone rubber roller under successive copying, and it finally causes a so-called "offset phenomenon" such that the toner is fused to a heating roller.

Further, the above-mentioned combination of two kinds of oil-soluble dyes has a tendency to decrease the triboelectric chargeability of a toner rather than enhance the chargeability. Accordingly, it can sufficiently prevent charge-up so as to guarantee a desirable image density under a low temperature - low humidity condition. However, under a high temperature - high humidity condition, the above-mentioned dyes are liable to cause toner scattering due to charging insufficiency, contamination in the copying machine due to the toner scattering, and fog in the resultant image due to toner particles having a smaller charge amount. As a result, they are liable to cause image staining.

As described above, the pigment-type colorant has some advantages such as light-resistance and little carrier staining, but it is inferior in dispersibility in a binder resin, and in the resultant color tone and saturation. On the other hand, when the dye-type colorant is used, it is superior in dispersibility in a binder resin so as to provide a toner excellent in color tone and saturation, but it has some disadvantages such as poor light-resistance, and considerable staining of a fixing roller.

From such a viewpoint, some attempts have been made by using a pigment-type colorant and a dye-type colorant in combination so as to compensate each disadvantage and to utilize each advantage.

For example, Japanese Laid-Open Patent Application No. 192957/1985 proposes a method wherein a pigment is treated with an oil-soluble dye so as to improve the dispersibility of the pigment in a binder resin. When such a method is utilized, good images having a clear hue can be obtained under various conditions such as high temperature - high humidity condition and low temperature - low humidity condition. However, in this method, fixability and prevention of silicone roller staining are not sufficient.

Japanese Laid-Open Patent Application No. 100453/1984 describes a method wherein an oil-soluble dye as an electroconductivity-imparting agent is incorporated in a polyester resin as a binder resin in order to prevent fog and edge effect, and such a polyester resin is used in a toner containing an organic pigment. In this method, the fog and edge effect can be suppressed due to the electroconductivity-imparting effect of the oil-soluble dye. However, in a case where toners of two or more color are mixed to provide another color toner, or toners of two or more colors are superposed and fixed onto a transfer material such as plain paper, the dispersibility of the pigment is insufficient to provide images poor in saturation and light-transmissivity or transparency.

Japanese Laid-Open Patent Application No. 66261/1985 proposes a method using a chromatic pigment and at least one species of an organic solvent-soluble chromatic dye for a functional color toner. However, since this method provides a toner having a high hiding power, the resultant toner can provide images poor in color-mixing property and light-transmissivity, when used as a full-color toner.

Japanese Laid-Open Patent Application Nos. 15555/1987, 15556/1987 and 15557/1987 teach that in the examples of practice thereof, when a combination of a pigment and rhodamine-type basic dye is used as a colorant, offset and dyeing of a silicone rubber roller do not occur. However, sufficient dispersibility of the colorant cannot be obtained by such a method and the resultant toner particles are liable to agglomerate and to cause a phenomenon such that the toner particles are attached to the periphery of carrier and the carrier migrates to a photosensitive drum together with the toner particles.

Japanese Laid-Open Patent Application No. 5733/1979 proposes a method of providing a color toner wherein a basic dye is treated with a resin having an acid value of 5–120. In this method, the basic dye forms a kind salt with the acidic group of the resin to provide a color toner which is excellent in spectral reflection characteristic and transparency, and stable in fluidity and triboelectric chargeability. However, since this method uses the dye alone, the resultant toner is poor in light-resistance and the faded toner image has very little reddish tone.

Japanese Laid-Open Patent Application No. 280755/1987 proposes a method wherein a polyester resin as a binder resin, and a pigment treated with a polyester resin having a higher molecular weight than the binder resin are used in order to improve the dispersibility of the pigment and to obtain a toner excellent in color reproducibility and chargeability. This method may provide a toner considerably improved in pigment dispersibility and chargeability as compared with a conventional toner using a pigment alone. However, the resultant toner is somewhat inferior in color tone and saturation to a dye-type colorant, as described herein above.

Japanese Laid-Open Patent Application No. 30259/1987 proposes a method of preparing a mixture comprising a pigment, a dye, a charge controller and an anti-offset agent, and diluting the mixture with a resin so as to provide a prescribed content. This method can improve the dispersibility of the colorant, but cannot improve toner fixability and anti-staining property with respect to a silicone roller and toner fixability.

On the other hand, there have been proposed various methods for the purpose of improving the fixability. For example, Japanese Laid-Open Patent Application Nos. 226358/1984 and 126562/1986 propose a color toner comprising a polymer or copolymer of a vinyl-type monomer which has at least one maximum value (or peak) in each of the molecular weight range of $10^3$ $-5\times10^4$ and $10^5$ $-10^6$, measured by GPC (gel permeation chromatography). When about 70% of such a polymer having a maximum value in the molecular weight range of $10^5$–$10^6$ is incorporated in the toner, the anti-high temperature offset property is improved, but the toner viscosity is increased and the color mixing property for full-color image formation is deteriorated, thereby to provide blurred images having low saturation.

Japanese Patent Publication No. 23084/1978 proposes a method wherein an oligostyrene having a molecular weight of 1,000 or lower and a polystyrene having a molecular weight of several tens of thousand or higher are used as a binder resin. This method can improve the fixability of a toner as compared with that using polystyrene alone. However, when the resultant toner is used for full-color image formation, particularly when the amount of toner particles attached to the image is large so as to provide a black color based on a superposition of toners of three colors, the fixability is still insufficient.

As described above, there has been desired a magenta toner which provides good light-resistance and high saturation as a color toner, good charging stability, and excellent anti-offset property.

SUMMARY OF THE INVENTION

An object of the present invention is to provide a color toner which has solved the above-mentioned problems encountered in the prior art.

Another object of the present invention is to provide a color toner capable of providing a clear or vivid color.

A further object of the present invention is to provide a color toner capable of preventing or suppressing dyeing deterioration of a silicone rubber roller, etc.

A further object of the present invention is to provide a color toner having a triboelectric chargeability excellent in environmental stability.

A further object of the present invention is to provide a color toner excellent in light-resistance.

A further object of the present invention is to provide a magenta toner capable of being fixed in a wide temperature range in heat roller fixing.

A still further object of the present invention is to provide a magenta toner capable of providing a smooth surface of a fixed toner image so that light incident to the fixed toner image does not cause diffused reflection to impair color reproducibility.

According to the present invention, there is provided a color toner for developing an electrostatic latent image comprising: a binder resin, a xanthene-type dye and a compound containing a phenolic —OH (hydroxyl) group.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3 shows a GPC chart of a resin A prepared by using the polymer a;

FIG. 4 shows a GPC chart of a resin A prepared without using the polymer a.

DETAILED DESCRIPTION OF THE INVENTION

Figure 1:
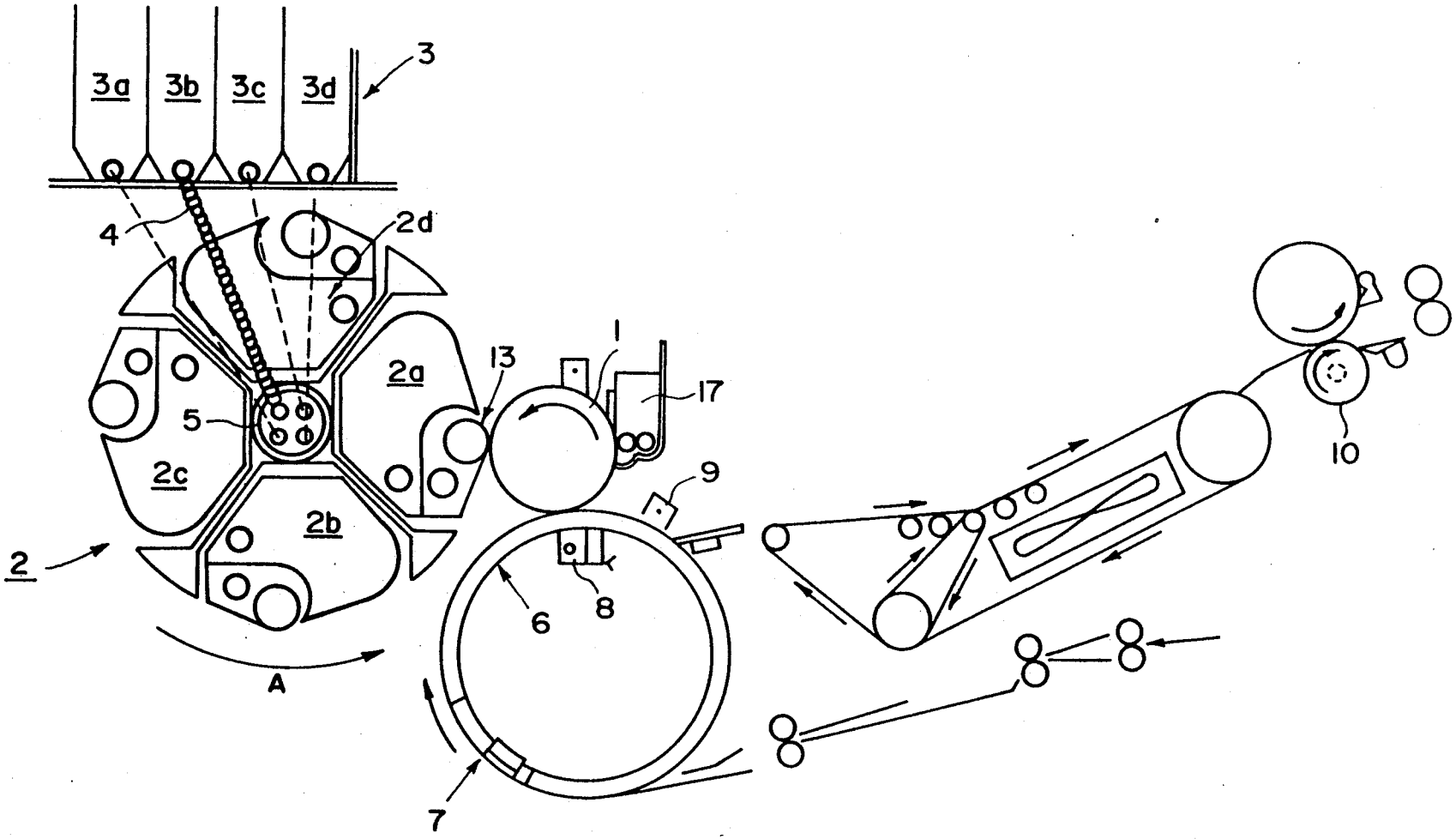
FIG. 1 is a schematic sectional view showing an outline of a color electrophotographic copying machine to which the color toner accoarding the present invention is applied.

In a preferred embodiment of the present invention, the toner contains a colorant comprising a xanthene-type dye treated with a compound having a phenolic —OH (hydroxyl) group. In the present invention, it is further preferred to use a quinacridone-type pigment in combination with such a xanthene-type dye.

The xanthene-type dye may preferably comprise a rhodamine-type colorant, which is a fluorescent colorant showing a clear bluish pink color. Accordingly, the xanthene-type dye may be used in many cases singly or in combination with another colorant, as a magenta, red or orange colorant. When the xanthene-type dye is added to a toner, it tends to decrease the charging amount of the toner, so that the resultant toner is liable to cause fog or scattering under a high temperature - high humidity condition. Further, in the prior art, the xanthene-type dye has a problem such that it can easily migrate to another object to contaminate a fixing roller comprising a silicone rubber.

The present invention has solved such a problem of a xanthene-type dye and provides a color toner which is excellent in hue, saturation and chargeability and is not substantially deteriorated even under repetitive copying operations. In the present invention, the above-mentioned problem has been solved by treating a xanthene-type dye with a compound having a phenolic —OH group.

In the above-mentioned treatment in the present invention, a treated xanthene-type dye may be prepared by mixing a compound having phenolic —OH group and a xanthene-type dye. It is considered that when the treated xanthene-type dye is dispersed in a binder resin, it is not dispersed in the binder resin in a dissolved state as in the case of a xanthene-type dye alone, but the colored compound having a phenolic —OH group is dispersed in the binder resin. In such a case, the xanthene-type dye may be retained in the compound having a phenolic —OH group to a certain extent, and hardly migrates to the binder resin. Accordingly, the toner according to the present invention may remarkably reduce the contamination of a silicone fixing roller, as compared with that caused by a toner using a xanthene-type dye not being treated with a compound having a phenolic —OH group.

In the present invention, since the above-mentioned colored compound having a phenolic —OH group is dispersed in the binder resin, the xanthene-type dye present on the surfaces of toner particles which can cause a decrease in triboelectric chargeability may remarkably be reduced, as compared with in a case where a non-treated xanthene-type dye is dispersed in a binder resin. Accordingly, in the present invention, the toner may retain its high chargeability even under a high temperature - high humidity condition so as to prevent or remarkably reduce toner scattering and fog.

In most cases, a xanthene-type dye may generally be converted into a basic dye salt and used. Since a salt of the basic dye may considerably decrease its chargeability under a high-humidity condition, the basic dye to be used in the present invention may preferably be used in a free base or acid form rather than the salt form thereof in view of good humidity-resistance. In the present invention, a xanthene-type dye to be classified into a oil-soluble dye may preferably be used, since such a dye has good wettability with a resin so as to enhance the dispersibility thereof.

Specific examples of the xanthene-type oil-soluble dye may include: C.I. 45170:1 (C.I. Solvent Red 49), C.I. 45185, C.I. 45190:1 (C.I. Solvent Violet 10), C.I. 45195, C.I. 45350:1 (C.I. Solvent Yellow 94). C.I. 45365 (C.I. Solvent Orange 32), C.I. 45366 (C.I. Solvent Red 42), C.I. 45370:1 (C.I. Solvent Red 72), C.I. 4371 (C.I. Solvent Orange 18), C.I. 45380:2 (C.I. Solvent Red 43), C.I. 45385 (C.I. Solvent Red 44), C.I. 45386 (C.I. Solvent Red 45), C.I. 45395, C.I. 45396 (C.I. Solvent Orange 16), C.I. 45410 (C.I. Solvent Red 48), C.I. 45415, C.I. 45425:1 (C.I. Solvent Red 73), C.I.45430 (C.I. Solvent Red 140), C.I. 45435:1 (C.I. Solvent Red 47), C.I. 45440:1 (C.I. Solvent Red 141), C.I. 45456 (C.I. Solvent Orange 17), C.I. 45457 (C.I. Solvent Red 46), C.I. 45550 (C.I. Solvent Green 4), etc.

In an embodiment wherein a conventional quinacridone pigment is used in combination with the above-mentioned dye, it is preferred to select a xanthene-type dye having a somewhat bluish pink color, corresponding to a somewhat reddish color of the quinacridone pigment. Particularly, it is preferred to use 40 wt. parts or less (more preferably 20 wt. or less, particularly preferably 1–15 wt. parts) with respect to 100 wt. parts of the quinacridone-type pigment, in order to compensate the light-fading of the xanthene-type dye and to cause the quinacridone pigment to exhibit its light-resistance. Particularly preferred examples of the xanthene-type dye used for such a purpose may include C.I. 45190:1 (C.I. Solvent Violet 10) and C.I. 45170:1 (C.I. Solvent Red 49).

In the present invention, it is preferred to use 1–18 wt. parts (more preferably 2–15 wt. parts of a colorant such as xanthene-type dye and quinacridone pigment with respect to 100 wt. parts of the toner, so that the addition thereof does not substantially affect the fixability of the toner.

The compound having a phenolic —OH group may for example be a phenolic resin. The phenolic resin may be an addition condensation product formed by a reaction of a phenolic —OH group and an aldehyde group. Specific examples of the phenolic —OH group-containing compound used herein may include: phenol, cresol, xylenol, catechol, naphthol, alkylphenol, paraphenylphenol, etc. Specific examples of the aldehyde group-containing compound (or compound capable of providing an aldehyde group) used herein may include: formaldehyde, acetaldehyde, paraformaldehyde, hexamethylenetetramine, furfural, etc. Among these, it is preferred to use a phenol compound having an alkyl, aryl or aralkyl group in the para-position with respect to the phenolic hydroxyl group (i.e., so-called "oil-soluble phenol"), in view of toner production, since it has good heat stability.

Japanese Patent Publication Nos. 25663/1973 and 16150/1976 have proposed a phenolic resin as a binder for toner. In such a case, however, the phenolic resin is used in a relatively large amount of 10–90 wt. %, preferably 10–50 wt. %, based on the total weight of the toner. Japanese Laid-Open Patent Application No. 5733/1979 proposes a phenolic resin as a charge controller. In this case, however, the phenolic resin is used in a large amount of 5–50 wt. % in the form of a modification with rosin. Japanese Laid-Open Patent Application Nos. 15555/1987, 15556/1987 and 15557/1987 propose the use of simple phenol ($C_6H_5OH$) in an amount of 10 wt. %. In these references, however, the action of the simple phenol is considerably weaker than a dye-type charge controller, and therefore it performs only a subsidiary function. Further, Japanese Patent Publication 9415/1983 proposes the use of oil-soluble paraphenylphenol as a dispersant. In this case, the paraphenylphenol is used in a relatively small amount of 1–20 wt. %, but an amount of 5 wt. % or larger is preferred.

In the present invention, it is preferred to use a quinacridone-type pigment, a xanthene-type dye and a phenolic resin in combination. The reason for such a combination is specifically described below.

As described hereinabove, when a dye alone is used as a colorant, it tends to cause dyeing and offset on a fixing roller. When a dye and a pigment are simply used in combination, such a combination is not necessarily dispersed sufficiently in a binder resin comprising a polyester-type resin or styrene-acrylic resin which has generally been used for a toner. When a pigment alone is used as a colorant, the resultant image has a good light-resistance but is poor in saturation.

The xanthene-type oil-soluble dye has little compatibility with a non-polar organic compound having an aromatic ring, has a strong coloring power to oil, rubber and metal oxide, and has a good solubility in alcohols, ethers, ketones and esters having a low-molecular weight. Accordingly, when the xanthene-type dye is used in combination with a toner binder containing a non-polar aromatic ring to which the aromatic ring has been introduced so as to impart durability to an electrophotographic toner, it tends to contaminate respective parts of an electrophotographic apparatus rather than is retained in the toner binder resin. More specifically, the oil-soluble xanthene dye tends to contaminate respective parts such as carrier comprising a material such as iron oxide powder, magnetite, ferrite, or magnetizable alloy; a sleeve for carrying a developer; silicone rubber used for a fixing device; and silicone oil used for a release agent, at the time of a high temperature. As a result, charging performance is considerably deteriorated under a high humidity condition, and toner scattering, fog and shadowing can be caused in some cases. When the thus obtained fixed image is placed in contact with a material containing a plasticizer, the oil-soluble xanthene-type oil-soluble dye is extracted, whereby the periphery of the image is stained and the magenta color in the image is blurred or faded.

In the present invention, however, the above-mentioned staining phenomenon may firmly be suppressed, a phenolic resin containing a polar group coexists with the xanthene-type dye.

In the present invention, the phenolic resin may preferably show its effect in an amount of 10 wt. parts or more, (more preferably 20–200 wt. parts, particularly preferably 50–150 wt. parts) per 100 wt. parts of the xanthene-type dye.

The phenolic resin is advantageous to a binder resin because of its low melting point and good adhesion property, but can easily be colored by heat, light, oxygen, etc. In a case where the toner is used for full-color image formation and the chromatic requirements are severe, it is preferred to reduce the amount of the phenolic resin used therein. In view of an intended effect, it is sufficient to use the phenolic resin in an amount which is two times or smaller that of the xanthene-type dye. Further, in general, the amount of 5 wt. % thereof based on the total toner weight is not required. In practice, it is preferred to use the phenolic resin in an amount of 1 wt. % or less, based on the total toner weight.

When the toner according to the present invention is used as a mono-color toner which is not intended for subtractive color process in combination with another color toner, it is possible to increase the phenolic resin content.

The color toner according to the present invention may be prepared in the same manner as in the conventional color toner.

For example, the above-mentioned materials are sufficiently mixed by using a mixer such as Henschel mixer, melt-kneaded, and after cooling, the kneaded product is pulverized to prepare a toner. In order to more efficiently obtain the intended effect, it is further preferred that a xanthene-type dye and a phenolic resin are preliminarily mixed by the medium of a small amount of a solvent or under heating and melting, and the resultant mixture is then mixed with the other materials for the toner. It is considered that the xanthene-type dye is not completely dissolved in the phenolic resin. The reason for this is not necessarily be clear but may presumably be considered that the phenolic resin has a function of suppressing the migration of the dye in the main binder component.

In order to more efficiently obtain the intended effect, it is preferred to use a dye preliminarily treated with a phenolic resin before it is dispersed in a binder resin. For the purpose of improving the dispersibility of a pigment, it is possible to add the pigment to a monomer when the monomer is polymerized to obtain a main binder resin component, or to treat the pigment simultaneously with the treatment of the dye with the phenolic resin.

In order to treat the xanthene-type dye according to the present invention with a phenolic resin, various methods may be used as follows.

(1) A method wherein a xanthene-type dye and a phenolic resin is melt-kneaded by means of a twin-roll mill, Banbury mixer, kneader, triple-roll mill, etc.

(2) A method wherein a phenolic resin is dissolved in an appropriate solvent, and a xanthene-type dye is then dissolved or dispersed in the resultant solution, and the solvent is removed and the resultant product is dried.

(3) A method wherein a xanthene-type dye is dissolved or dispersed in a mixture of a phenol and formaldehyde, an alkali is added to the solution or dispersion and the resultant mixture is heated to form a three-dimensional structure.

(3) A method wherein a xanthene-type dye is dissolved or dispersed in a mixture of a phenol and formaldehyde, the resultant mixture is formed into a novalak resin in the presence of an acid catalyst, and a crosslinking agent such as hexamethylenetetramine is added to the novalak resin to be cured or hardened.

In an embodiment wherein the color toner according to the present invention is formed into a magenta toner, a quinacridone pigment may preferably be used in combination.

The quinacridone-type pigment is a high-grade pigments having a somewhat reddish color and is excellent in light resistance and charging stability but it does not exhibit sufficient magenta performances when singly added to a toner. More specifically, with respect to the hue, it provides less reflection corresponding to a blue color and the color thereof deviates to the red color side, as compared with an ideal magenta color. Further, saturation may be poor in view of clearness, whereby the resultant vividness becomes insufficient. In other words, when the quinacridone pigment is used singly, it only provides insufficient quality with respect to color reproducibility. However, when the quinacridone pigment is used in combination with the phenolic resin and xanthene-type dye, the problems of the quinacridone pigment (e.g., hue and saturation) may be solved thereby to provide a magenta toner which does not cause roller staining, and does not decrease its chargeability even under a high temperature - high humidity condition.

Typical examples of the quinacridone pigment are shown in the following Table 1.

TABLE 1

| Color Index | Formula |
|---|---|
| (1) C.I. Pigment Red 202, 209 | 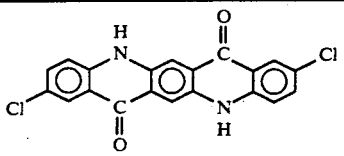 |
| (2) C.I. Pigment Red 206 | 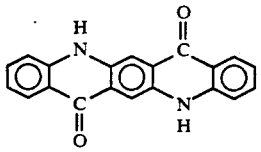 |
| | 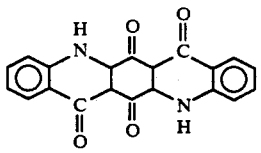 |
| (3) C.I. Pigment Red 207 | 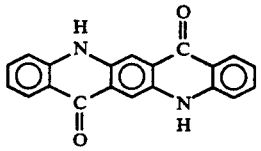 |
| | 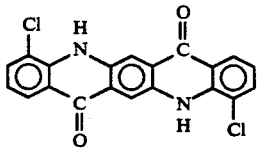 |
| (4) C.I. Pigment Violet 19 | 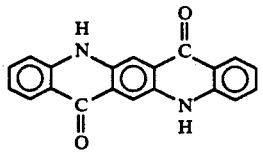 |

TABLE 1-continued

| Color Index | Formula |
|---|---|
| (5) C.I. Pigment Red 122 | 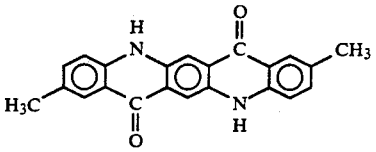 |

Among these, C.I. Pigment Red 122 represented by the above formula (5) is particularly preferred as a magenta colorant.

In the present invention, the mixing wt. ratio of (quinacridone-type pigment/xanthene-type dye) may preferably be 100/1 to 100/40, more preferably 100/3 to 100/20. In order to obtain a color toner having another hue, a known red or orange colorant may be used in combination therewith.

In the present invention, a known resin may be used as the binder resin for toner. Specific examples thereof may include: polymers or copolymers of a vinyl compound such as styrene, acrylic acid methacrylic acid and their esters, vinyl butyral, vinyl chloride and vinyl acetate; condensation-type resins such as polyester resin, polyurethane, polyamide, and epoxy resin; and rosin, modified rosin, terpene resin, aliphatic hydrocarbon resin, alicyclic hydrocarbon resin, and aromatic petroleum resin. These resins may be used singly or as a mixture of two or more species thereof.

A release agent such as wax can also be incorporated in the toner. Specific examples of the wax may include polymers of an olefin such as polyethylene and polypropylene; copolymers comprising an olefin such as ethylene and propylene; and waxes such as paraffin wax, amide wax, montan wax and carnauba wax.

It is preferred that in a fixed color toner image, the diffused reflection due to toner particles is suppressed as completely as possible, and the fixed image has appropriate gloss. Further, the color toner may preferably have a transparency or light-transmissivity such that when toners of respective colors are superposed on another toner layer having a different color, they do not substantially hide the color of the other toner layer disposed below the layer. In order to meet these requirements, it is necessary that the toner binder resin is rapidly fluidified, so that respective toner particles are fused and smoothed and do not cause a decrease in transparency.

As the resin satisfying the above-mentioned characteristics, it is preferred to use a polyester-type resin for the purpose of providing a transparent binder having a sharp melting property. Preferred examples thereof may include those comprising a etherified bisphenol as an alcoholic component such as polyoxypropylene (2,2)-2,2-bis(4-hydroxyphenyl)propane, and polyoxyethylene (2,2)-2,2-bis(4-hydroxyphenyl)propane; and an unsaturated chain (or binder) dibasic acid as an acid component such as maleic acid and fumaric acid.

Particularly, in view of anti-offset property in heat roller fixing, it is preferred to use an aromatic multifunctional carboxylic acid such as terephthalic acid and trimellitic acid. Since a hard resin tends to be formed in such a case, it is preferred to use a dicarboxylic acid having a substitutent of a hydrocarbon group of $C_6$ to $C_{16}$. Preferred examples thereof may include: alkenylsuccinic acid such as n-dodecenylsuccinic acid, and alkylsuccinic acid such as n-octylsuccinic acid. Further, it is preferred to use an alcohol component having a long chain, such as polyethylene oxide and polypropylene oxide. When such an alcohol component is incorporated in a polyester resin, an appropriate softness may be imparted to the toner at the time of melting thereof.

The polyester resin may preferably have a glass transition point of 50°-70° C., in view of balance between storability and fixing temperature of a toner.

The polyester resin may preferably have a weight-average molecular weight of 1,000 to 100,000. When the polyester resin has a temperature providing a melt viscosity of $10^6$ poise of below 100° C., and a temperature providing a melt viscosity of $10^5$ poise of below 110° C., the polyester resin may little damage the rubber of a fixing roller in heat roller fixing.

In the case of a negatively chargeable toner, the polyester resin may preferably have an acid value of 2.0 or higher. When the acid value of the polyester resin exceeds 100, the hygroscopicity of the polyester resin is increased. Accordingly, the polyester resin may preferably have an acid value of 100 or lower, more preferably 2-60.

As the binder resin of a color toner, a styrene-type resin satisfying the following characteristics may preferably be used.

The styrene-type resin used in the present invention may preferably have a molecular weight distribution based on GPC (gel permeation chromatography) such that there is at least one maximum value (or peak) in the molecular weight range of below 10,000; there is no maximum value in the molecular weight range of 10,000 or higher; the area A corresponding to the molecular weight of below 10,000 in the GPC chromatogram, the area B corresponding to the molecular weight of 10,000-50,000, and the area C corresponding to the molecular weight of above 50,000 respectively have proportions of 55-80%, 5-25% and 2-20%. Further, when the Tg (glass transition point) of the styrene-type resin corresponding to the above-mentioned area A is denoted by Tg(A), and the Tg of the styrene-type rein corresponding to the above-mentioned area B and C is denoted by Tg(B+C), they may preferably satisfy the following relationship of:

$$70^\circ\ C. > Tg(A) > 50^\circ\ C., \text{ and}$$

$$65^\circ\ C. > Tg(B+C) > 50^\circ\ C.$$

In view of a color toner, color reproducibility is first important. Particularly, at the time of fixing, since respective color toners such as cyan toner, magenta toner and yellow toner are melted and subjected to color mixing so as to provide a desired color, these toners are required to be rapidly converted into a low-viscosity state at the time of fusion thereof. Practical performances of the color toner is secondly important. Particularly, with respect to the fixing characteristic, fixing temperature, anti-offset property and anti-winding property are satisfied simultaneously with the color mixing property.

As a result of our study, we have found that the above-mentioned properties are simultaneously satisfied to provide an excellent toner for full-color image formation, by regulating the molecular weight distribution and glass transition point of a styrene-type resin and incorporating a phenolic resin in a main binder component.

According to our investigation, in a molecular weight distribution based on gel permeation chromatography (GPC), the component corresponding to a molecular weight region of below 10,000 particularly relates to color-mixing property and flatness of the surface of a fixed toner image which are most important to a full-color toner, the component corresponding to a molecular weight region of 10,000-50,000 particularly relates to the fixing temperature, and the component corresponding to a molecular weight region of above 50,000 particularly relates to anti-offset property, anti-winding property, colorant dispersibility, developing property and durability of the toner.

When the content of the component having a molecular weight of below 10,000 is lower than 55%, the color-mixing property and flatness of a fixed toner image surface tend to be deteriorated. When the content is higher than 80%, the anti-offset property, colorant dispersibility and developing property tend to be deteriorated.

When the content of the component having a molecular weight of 10,000 to 50,000 is lower than 5%, the colorant dispersibility tends to be deteriorated. When the content is higher than 25%, the fixability may pose a problem.

When the content of the component having a molecular weight of above 50,000 is lower than 5%, the anti-offset property, anti-winding property, colorant dispersibility, developing property, durability, half-tone reproducibility may pose a problem. Particularly, the image density and background staining may be deteriorated. When the content is higher than 20%, the fixability, color-mixing property and flatness of a fixed toner image surface may pose a problem.

When Tg of the respective components is lower than 50° C., blocking is liable to occur. When the Tg(A) exceeds 70° C., the fixability, color-mixing property and surface flatness of a fixed toner image may pose a problem. When the Tg(B+C) excess 65° C., the fixability, color-mixing property and surface flatness of a fixed toner image may pose a problem.

For the above-mentioned reason, the styrene-type polymer may preferably have an acid value of 90 or lower, more preferably 2-60, particularly preferably 2-50.

The styrene-acrylic copolymer predominantly comprising a styrene-type monomer may easily be charged either positively or negatively, by using an appropriate charge controller. It is important that a styrene-type resin has a small amount of polar group and a dye or pigment is less liable to be dispersed therein. However, we have found that when the styrene-type resin having the above-mentioned specific molecular weight distribution is used, sufficient dispersibility may be obtained. Particularly, we have found that the dispersibility relates to the ratio between the component having a molecular weight of above 50,000 and the component having a molecular weight of below 10,000 may preferably be 1:7.5 to 2:5.5. In other words, the dispersibility may be improved on the basis of an appropriate proportion of the component having a molecular weight of 50,000 or higher which relates to shear force at the time of melt-kneading, to the component of a molecular weight of 10,000 or lower which relates to good wettability.

The molecular weight and glass transition point used in the present invention may be measured in the following manner.

(1) Measurement of molecular weight

In the present invention, the molecular weight of a peak or maximum value in a chromatogram by GPC (gel permeation chromatography), may be measured under the following conditions.

Through a column stabilized in a heat chamber at 40° C., THF (tetrahydrofuran) as the solvent is permitted to flow at a rate of 1 ml/min., and 50 to 200 μl of a THF sample solution of a resin controlled to a sample concentration of 0.05 to 0.6 wt. % is injected for measurement. In measuring the molecular weight of the sample, the molecular weight distribution possessed by the sample is calculated based on a calibration curve prepared from several kinds of mono-dispersed polystyrene standard samples showing a relationship between the logarithmic value of the molecular weights and the count numbers. As the standard polystyrene samples for preparation of the calibration curve, for example, those produced by Pressure Chemical Co. or Toyo Soda Kogyo K.K., having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2.10^6$ and $4.48\times10^6$ may be employed, and it is suitable to use at least 10 points of standard polystyrene samples. As the detector, an RI (refractive index) detector is used.

As the column, for measuring adequately a molecular region of $10^3$–$2\times10^6$, a plurality of commercially available polystyrene gel columns may be preferably combined. For example, a combination of u-styragel 500, $10^3$, $10^4$ and $10^5$ produced by Waters Co., a combination of Shodex KF-80M, KF-801, 803, 804 and 805, a combination of KA-802, 803, 804 and 805, or a combination of TSKgel G1000H, G2000H, G2500H, G3000H, G4000H, G5000H, G6000H, G7000H and GMH produced by Toyo Soda K.K., are preferred.

(2) Measurement of glass transition temperature Tg

A differential scanning calorimeter DSC-7 (available from Perkin Elmer Corp.) is used.

A sample is accurately weighed in 5–20 mg, preferably about 10 mg. The sample is placed on an aluminum pan with the use of an empty aluminum pan as the reference and is subjected to DSC in the temperature range of 30 to 200° C. at a temperature raising rate of 10° C./min in the environment of normal temperature and normal humidity. The absorption peak referred to herein is a temperature at which a main absorption peak is observed in the temperature range of 40°–100° C.

Based on the measurement, a center line of the base lines appearing before and after the endothermic peak is determined so that the center line is parallel to both of the above-mentioned base lines and is disposed with the same distances from both of these base lines. In the present invention, Tg is defined as the intersection of such a center line and the differential thermal curve measured in the above-described manner.

The styrene-type resin used in the color toner of the present invention may preferably be polymers or copolymers obtained by polymerization of at least one monomer selected from styrene type monomers, acrylic acid type monomers, methacrylic acid type monomers and derivatives thereof in view of developing characteristic and charging characteristic. Examples of the monomers may include: styrene type monomers such as styrene, α-methylstyrene, vinyltoluene, chlorostyrene and the like; acrylic acid type monomers, methacrylic acid type monomers and derivatives thereof such as acrylic acid, methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, dimethylaminoethyl acrylate and other acrylates, methacrylic acid and methacrylates such as methyl methacrylate, ethyl methacrylate, propyl methacrylate, butyl methacrylate, amyl methacrylate, hexyl methacrylate, 2-ethylhexyl methacrylate, octyl methacrylate, decyl methacrylate, dodecyl methacrylate, lauryl methacrylate, cyclohexyl methacrylate, phenyl methacrylate, 2-hydroxyethyl methacrylate, 2-hydroxypropyl methacrylate, dimethylaminoethyl methacrylate, glycidyl methacrylate, stearyl methacrlate and the like. Other than the monomers as mentioned above, a small amount of other monomers within the range which can accomplish the objects of the present invention may be employed, such as acrylonitrile, 2-vinylpyridine, 4-vinylpyridine, vinyl carbazole, vinyl methyl ether butadiene, isoprene, maleic anhydride, maleic acid, maleic acid monoesters, maleic acid diesters, vinyl acetate.

As the crosslinking agent to be used in the toner of the present invention, there may be included as a bifunctional crosslinking agent, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate triethylene glycol diacrylate, tetraethylene glycol diacrylate, respective diacrylates of polyethylene glycol #200, #400, #600, dipropylene glycol diacrylate, polypropylene glycol diacrylate, polyester type diacrylate (MANDA, Nippon Kayaku, K.K.), and methacrylates corresponding to the above acrylates.

Examples of polyfunctional crosslinking agent may include: pentaerythritol acrylate, trimethylolethane triacrylate, trimethylolpropane triacrylate, tetramethylolmethane tetraacrylate, oligoester acrylate, and corresponding methacrylates, 2,2-b9s(4-methacryloxypolyethoxyphenyl)propane, diallyl phthalate, triallyl cyanurate, triallylazo cyanurate, triallyl isocyanurate, triallyl trimellitate, and diallyl chlorendate.

The method for synthesizing the binder resin according to the present invention may preferably be a method in which two or more kinds of polymers are synthesized.

In the present invention, the above-mentioned two species of resins may be mixed by: a method wherein these resins are mixed in a melt-kneading step in the toner production process; a method wherein the respective resins are melted and mixed with each other in the melted state; or a method wherein these resins are mixed by using a solvent. However, in the present invention, it is preferred that a first resin is prepared by solution polymerization, and, after, the preparation of the first polymer, a monomer and a polymerization initiator for forming a second polymer are added to the resultant product, and subjected to the second polymer preparation, thereby to obtain a mixture resin wherein the first and second resins are uniformly mixed. Such a method is preferred because two species of resins can be mixed at their molecular levels. When a polymer is formed by such a method, it is possible to form either of the low-molecular weight component or high-molecular weight component in advance.

Further, in such a two-step (or two-stage) polymerization, an arbitrary combination of polymerization processes may be used in addition to the above-mentioned combination of solution polymerization and solution polymerization. However, in view of a reaction treatment step, a combination of solution polymerization and suspension polymerization is preferred.

The phenolic resin content, quinacridone pigment content and oil-soluble xanthene-type dye content may preferably be 0.01–20 parts (more preferably 0.1–5 parts), 0.5–20 parts (more preferably 1–10 parts), and 0.01–10 parts (more preferably 0.1–5 parts), respectively, with respect to 100 wt. parts of the styrene-type resin.

When the phenolic resin content is below 0.01 part, it shows little effect in view of the prevention of dyeing offset of fixing roller due to a dye. On the other hand, since the phenolic resin may easily be colored by heat, light, oxygen, etc., when the phenolic resin content exceeds 20 parts, the resultant copied image may be poor in saturation or light-transmissivity on an OHP film.

When the quinacridon pigment is below 0.5 part, the light-resistance may be poor. On the other hand, when the quinacridone pigment content exceeds 20 parts, the resultant copied image may be poor in saturation or light-transmissivity on an OHP film.

When the oil-soluble xanthene-type dye content is below 0.01 part, the addition of the dye does not substantially enhance the saturation. When the content is above 10 parts, the light-resistance becomes poor and dyeing offset on a fixing roller is liable to occur.

When the ratio of the oil-soluble xanthene-type dye to the phenolic resin is in the range of 1:10 to 1:01, the phenolic resin may sufficiently show its effect on the prevention of dyeing offset on a fixing roller.

The color toner according to the present invention may be either negatively chargeable or positively chargeable. In the case of a negatively chargeable toner, it is preferred to add a charge control agent in order to stabilize the negative chargeability of the toner according to the present invention. In such an embodiment, it is preferred to use a colorless or thin-colored negative charge control agent so as not to affect the color tone of the toner. The negative charge control agent may for example be an organo-metal complex such as a metal complex of alkyl-substituted salicyclic acid (e.g., chromium complex or zinc complex of di-tertiary-butylsalicyclic acid).

In the case of a positively chargeable color toner, it is possible to use a binder resin containing 0.1–40 mol % (preferably 1–30 mol %) thereof of an amino-carboxylic acid ester such as dimethylaminomethyl methacrylate showing a positive chargeability as a monomer, or to use a colorless or thin-color positive charge controller.

Specific examples of the positive charge controller may include quaternary ammonium salts represented by the following formulas (II) and (III):

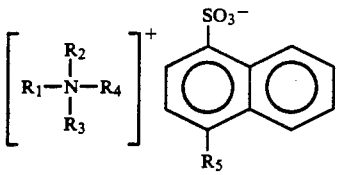

(II)

wherein $R_1$, $R_2$, $R_3$ and $R_4$ respectively denote an alkyl group having 1–10 carbon atoms, or an aralkyl group represented by —R'— wherein R' denotes an alkylene group having 1–15 carbon atoms, and $R_5$ denotes —H, —OH, —COOH, or an alkyl group having 1–5 carbon atom.

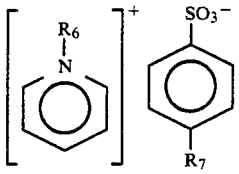

(III)

wherein $R_6$ denotes an alkyl group having 1–5 carbon atoms, and $R_7$ denotes —H, —OH, —COOH, or an alkyl group having 1–5 carbon atoms.

Among the quaternary ammonium salts represented by the formulas (II) and (III), a positive charge controller represented by the following formula (III)-1, (II)-2 or (III)-1 is particularly preferred in order to obtain good chargeability with little environmental dependence:

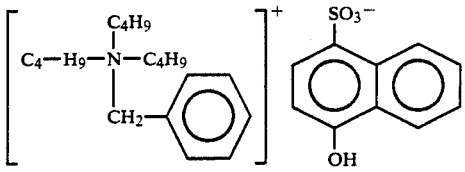

(III)-1

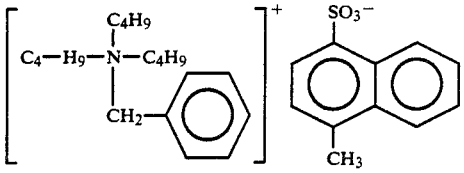

(II)-2

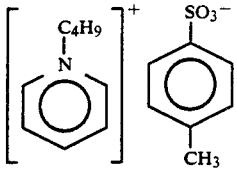

(III)-1

In the case of a positively chargeable color toner using an amino-carboxylic acid ester such as dimethylaminomethyl methacrylate showing a positive chargeability as a binder resin component, it is preferred to use a positive or negative charge controller, as desired.

In the case of the negatively chargeable color toner, it is preferred to use 0.1–15 wt. parts (more preferably 0.5–10 wt. parts) of the negative charge controller, per 100 wt. parts of a binder resin.

In the case of the positively chargeable color toner, when the above-mentioned amino-carboxylic acid ester such as dimethylaminomethyl methacrylate showing a positive chargeability is not used, it is preferred to use 0.1–15 wt. parts (more preferably 0.5–10 wt. parts) of the positive charge controller, per 100 wt. parts of a binder resin.

In a case where the amino group-containing carboxylic acid ester is used, it is preferred to use 0 –10 wt. parts (more preferably 0–8 wt. parts) of the positive and/or negative charge controller, per 100 wt. parts of a binder resin, in order to obtain good chargeability with little environmental dependence.

The color toner according to present invention may preferably comprise the above-mentioned binder resin and colorant, and optionally a charge controller and fluidity improver, as desired.

In the particle size distribution of the color toner according to the present invention, it is preferred that the color toner has a volume-average particle size is 3–16 microns, more preferably 5–14 microns; contains 40% by number or less (more preferably 35% by number or less) of toner particles having a particle size of 5 microns or smaller, and contains 8% by volume or less (more preferably 5% by volume or less) of toner particles having a particle size of 20.2 microns or larger.

When the volume-average particle size exceeds 16 microns and/or the content of particles of 20.2 microns or larger exceeds 8% by volume, so-called "scattering" such as coarsening of an image or blurring in a letter portion is liable to become marked. The distribution by number of toner particles of 5 microns or smaller, i.e., fine powder content, closely relates to the amount of scattering. We have found that the fine powder content exceeding 40% provides two or more times the scattering amount corresponding to the more preferred fine powder content of 30%. The toner scattering considerably deteriorates the image quality of fixed images due to fog in the non-image portion, and contamination of a charger wire.

In the present invention, a fluidity improver may be added to the color toner to improve the fluidity or flowability of the toner. In the present invention, it is possible to use a fluidity improver as long as it can improve the fluidity of colored resinous particles (toner particles), when mixed with the colored resinous particles.

Examples of the fluidity improver may include powder of fluorine-containing resins such as poly-vinylidene fluoride powder and polytetrafluoroethylene powder), aliphatic acid metal salts such as zinc stearate, calcium stearate, lead stearate), metal oxide such as zinc oxide powder), fine powder silica (such as wet-process silica, and dry process silica), surface treated product of such silica with silane coupling agent, titanium coupling agent or silicone oil.

A preferred class of fluidity improver may be fine silica powder obtained by vapor phase oxidation of silicon halide, called dry-process silica or fumed silica. Such fine silica powder may, for example, be obtained by pyrolytic oxidation of gaseous silicon tetrachloride in oxygen-hydrogen flame. The basic reaction scheme may be represented as follows:

$$SiCl_4+2H_2+O_2 \rightarrow SiO_2+4HCL$$

In the above preparation step, it is also possible to obtain complex fine powder of silica and other metal oxides by using other metal halides such as aluminum chloride or titanium chloride together with silica halides.

It is preferred to use silica fine powder, of which mean primary particle size of desirably within the range of from 0.001 to 2 microns, particularly preferably of from 0.002 to 0.2 microns.

Commercially available silica fine powder produced through vapor-phase oxidation of silicon halide to be used in the present invention include those sold under the trade names as shown below.

| | |
|---|---|
| AEROSIL | 130 |
| (Nippon Aerosil K.K.) | 200 |
| | 300 |
| | 380 |
| | TT 600 |
| | MOX 170 |
| | MOX 80 |
| | COK 84 |
| Co-O-Sil | M-5 |
| (Cabot Co.) | MS-7 |
| | MS-75 |
| | HS-5 |
| | EH-5 |
| Wacker HDK N 20 | V 15 |
| (WACKER-CHEMIE GMBH) | N 20E |
| | T 30 |
| | T 40 |
| D-C Fine Silica | |
| (Dow Corning Co.) | |
| Fransol | |
| (Fransil Co.) | |

It is further preferred to use hydrophobic silica fine powder obtained by subjecting the dry-process silica fine powder to a hydrophobicity-imparting treatment. Such hydrophobic silica fine powder having a hydrophobicity of 30–80 as measured by the methanol titration is particularly preferred.

A hydrophobicity-imparting treatment may be effected by treating the silica fine powder with an organosilicon compound capable of reacting with or being physically adsorbed on the silica fine powder. It is further preferred to treat silica fine powder obtained by vapor phase oxidation of silicon halide, with an organic silicon compound.

Examples of the organosilicon compound include: hexamethyldisilazane, trimethylsilane, trimethylchlorisilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, and further dimethylethoxysilane, dimethyldimethoxysilane, diphenyldiethoxysilane, hexamethyldisiloxane, 1,3-divinyltetramethyldisiloxane, 1-3-diphenyltetramethyldisiloxane, and dimethylpolysiloxanes having 2 to 12 siloxane units per molecule and containing each one hydroxyl group bonded to Si at the terminal units and the like. These may be used alone or as a mixture of two or more compounds.

The treated silica fine powder may preferably have a particle size in the range of 0.003 to 0.1 micron. Examples of the commercially available products may include Tullanox-500 (available from Tulco Inc.), and AEROSIL R-872 (Nihon Aerosil K.K.).

With respect to the positively chargeable toner, it is possible to use positively chargeable silica fine powder, in order to improve the fluidity and to obtain good chargeability with little environmental dependence.

In order to obtain such positively chargeable silica fine powder, it is preferred to treat silica with a coupling agent or silicone oil containing an amino group. Specific examples thereof are described below.

$H_2NCH_2CH_2CH_2Si(OCH_3)_3$ $H_2NCH_2CH_2CH_2Si(OC_2H_5)_3$ $$H_2NCH_2CH_2CH_2\overset{CH_3}{\overset{|}{Si}}(OCH_3)_2$$

-continued

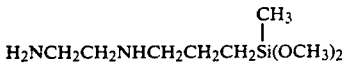

$H_2NCH_2CH_2NHCH_2CH_2CH_2Si(OCH_3)_3$
$H_2NCH_2CH_2NHCH_2CH_2HNCH_2CH_2CH_2Si(OCH_3)_3$
$H_3C_2OCOCH_2CH_2HNCH_2CH_2CH_2Si(OCH_3)_3$
$H_5C_2OCOCH_2CH_2NHCH_2CH_2NHCH_2CH_2CH_2SI(OCH_3)_3$
$H_5CH_2OCOCH_2CH_2NHCH_2CH_2NHCH_2CH_2NHCH_2CH_2NHCH_2Ch_2CH_2Si(OCH_3)_3$
$H_3COCOCH_2CH_2NHCH_2CH_2NHCH_2CH_2CH_2Si(OCH_3)_3$

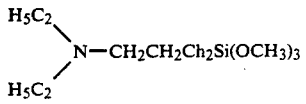

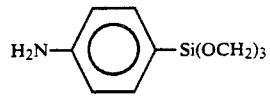

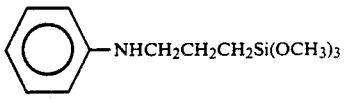

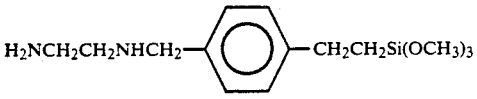

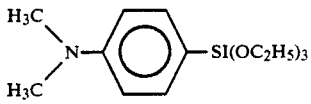

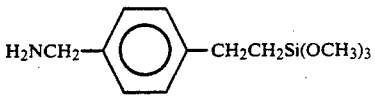

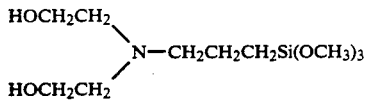

$(H_2CO)_3SiCH_2CH_2CH_2—NHCH_2$
$(H_2CO)_3SiCH_2CH_2CH_2—NHCH_2$

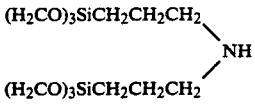

$H_2CNHCH_2CH_2CH_2Si(OC_2H_5)_3$
$H_2N(CH_2CH_2NH)_2CH_2CH_2CH_2Si(OCH_3)_3$
$H_3C—NHCONHC_3H_6Si(OCH_3)_3$

As the silicone oil, it is preferred to use an amino-modified silicone oil containing a partial structure represented by the following formulas:

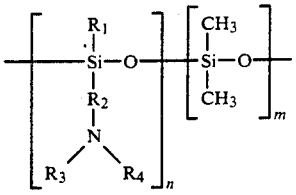

wherein $R_1$ denotes a hydrogen atom, alkyl, aryl or alkoxy group; $R_2$ denotes an alkylene or phenylene group; $R_3$ and $R_4$ respectively denote (a hydrogen atom) alkyl or aryl group provided that the above alkyl, aryl, alkylene or phenylene group is capable of having an amino group and is capable of having a substituent such as halogen atom as long as it does not substantially impair the chargeability; m and n respectively denote a positive integer.

Specific examples of such a silicone oil comprising an amino group may include those sold under the trade names as described below.

| Trade name | Viscosity at 25° C. | Amine equivalent |
|---|---|---|
| SF8417 (Toray Silicone K.K.) | 1200 | 3500 |
| KF393 (Shinetsu Kagaku K.K.) | 60 | 360 |
| KF857 (Shinetsu Kagaku K.K.) | 70 | 830 |
| KF860 (Shinetsu Kagaku K.K.) | 250 | 7600 |
| KF861 (Shinetsu Kagaku K.K.) | 3500 | 2000 |
| KF862 (Shinetsu Kagaku K.K.) | 750 | 1900 |
| KF864 (Shinetsu Kagaku K.K.) | 1700 | 3800 |
| KF865 (Shinetsu Kagaku K.K.) | 90 | 4400 |
| KF369 (Shinetsu Kagaku K.K.) | 20 | 320 |
| KF383 (Shinetsu Kagaku K.K.) | 20 | 320 |
| X-22-3680 (Shinetsu Kagaku K.K.) | 90 | 8800 |
| X-22-380D (Shinetsu Kagaku K.K.) | 2300 | 3800 |
| X-22-3801C (Shinetsu Kagaku K.K.) | 3500 | 3800 |
| X-22-3810B (Shinetsu Kagaku K.K.) | 1300 | 1700 |

The amine equivalent used herein is an equivalent weight per one amino group (g/equiv.) obtained by dividing the molecular weight by the number of the amino groups contained in one molecule.

It is preferred that the silica fine powder treated with the amino group-containing coupling agent or silicone oil is further subjected to hydrophobicity-imparting treatment by use of the above-mentioned organosilicone compound.

In the color toner according to the present invention, carrier used at the time of developing operation in combination therewith may also play an important role, in order to fully exhibit the intended effect of the toner.

The carrier used in the present invention may be composed of e.g., iron or an alloy of iron with nickel, copper, zinc, cobalt, manganese, chromium, and rare earth elements in the surface oxidized form or in the surface non-oxidized form, or of an oxide or ferrite form of these metal or alloys.

In the present invention, it is preferred to coat the surface of the carrier with a resin in view of durability. The carrier may preferably be coated with a coating material such as resin known methods such as those wherein the carrier is dipped in a solution or suspension of a coating material, or the carrier and the resin are simply mixed in their powder states, etc.

The coating material on the carrier surface may vary depending on the toner material and may, for example, be polytetrafluoroethylene, monochlorotrifluoroethylene polymer, polyvinylidene fluoride, silicone resin, polyester resin, metal complex of ditertiarybutylsalicyclic acid, styrene-type resin, acrylic resin, polyamide, polyvinylbutyral, nigrosine, aminoacrylate resin, basic dye or its lake, silica fine powder, and alumina fine powder. These coating materials may be used singly or in combination.

The coating amount of the above coating material may appropriately be determined so that the resultant carrier satisfies the above-mentioned condition but may generally be in a proportion of 0.1 to 30 wt. %, preferably 0.5–20 wt. %, in total, based on the carrier.

The carrier may preferably have an average particle size of 10–100 microns, more preferably 20–70 microns.

The carrier, in its particularly preferred form, may be composed of ternary magnetic ferrite of Cu-Zn-Fe surface-coated with a styrene resin alone or a resin combination, such as that of a fluorine-containing resin and a styrene-type resin. Examples of the combination include polyvinylidene fluoride and styrene-methyl methacrylate resin; polytetrafluoroethylene and styrene-methyl methacrylate resin; and fluorine-containing copolymer and styrene-type copolymer. The proportions of the fluorine-containing resin and the styrene-type resin may be 90:10 to 20:80, preferably 70:30 to 30:70. It is preferred to coat the ferrite particles with0.01 to 5 wt. %, particularly 0.1 to 1 wt. %, of the resin combination. The carrier may preferably have a particle size distribution such that particles in the range of 250 mesh-pass and 400 mesh-on occupy 70 wt. % or more. A further preferred example of the fluorine-containing resin includes vinylidene fluoride-tetrafluoroethylene copolymer (10:90 to 90:10) and examples of the styrene-type copolymer include styrene-2-ethylhexyl acrylate copolymer (20:80 to 80:20) and styrene-2-ethylhexyl acrylate-methyl methacrylate copolymer (20 to 60 : 5 to 30 : 10 to 50).

The coated ferrite carrier satisfying the above conditions has a sharp particle size distribution, provides a preferable triboelectric charge and provides a developer with improved electrophotographic characteristics.

A two-component developer may be prepared by mixing a color toner according to the present invention with a carrier so as to give a toner concentration in the developer of 2.0–15 wt. %, preferably 4–13 wt. %, which generally provides good results. A toner concentration of below 2.0% results in allow image concentration of above 15% is liable to result in increased fog and scattering of toner in the apparatus and a decrease in life of the developer.

The color toner containing a specific colorant according to the present invention may generally be prepared in the following manner.

(1) The binder resin and a colorant are blended by uniform dispersion by means of a blender such as Henschel mixer together with optionally added a charge controller.

(2) The above blended mixture is subjected to melt-kneading by using a melt-kneading means such as kneader, extruder, and roller mill.

(3) The kneaded product is cooled and coarsely crushed by means of a crusher such as cutter mill and hammer mill and then finely pulverized by means of a micropuverizer such as jet mill and I-type mill.

(4) The finely pulverized product is subjected to classification by means of a classifier such as zigzag classifier, and Elbow Jet Classifier, thereby to provide a color toner according to the present invention.

As another process for producing the color toner according to the present invention, a polymerization process or an encapsulation process can be used.

An example of a full-color electrophotographic copying machine to which the color toner according to the present invention may be applied is explained with reference to FIG. 1.

An electrostatic latent image formed on a photosensitive drum 1 by appropriate means is developed by a developer contained in a developing device 2*a* fixed on a rotary developing unit 2. The resultant toner image is transferred by the operation of a transfer charger 8 onto a transfer material such as plain paper held on a transfer drum, 6 by a gripper 7. A residual toner remaining on the photosensitive drum 1 is removed by a cleaning means 17.

For a second color development and transfer, the rotary developing unit 2 is rotated to have a developing device 2*b* face the photosensitive drum 1. A latent image on the photosensitive drum 1 is then developed by a developer in the developing device 2*b*, and the resultant toner image is again transferred in superposition on the same transfer material as described above.

The development and transfer are similarly conducted for third and fourth colors. In this way, the transfer drum 6 is rotated in a prescribed number of times while holding thereon the transfer material to transfer the prescribed number of color images in superposition. The corona charge for electrostatic transfer is preferably successively increased for successive color toner images by increasing the transfer current such that transfer current for first color < transfer current for second color < transfer current for third color < transfer current for fourth color, in order to reduce the amount of residual toner after the transfer. The transfer material after the multiple transfer is separated from the transfer drum 6 by means of a separation charger 9 and passed through a fixer 10 to provide a full-color copy image.

Replenishing toners supplied to developing devices 2*a* to 2*d* are supplied from replenishing hoppers 3 provided for respective color toners in a constant amount based on a replenishing signal through toner-conveying cables 4 to toner replenishing tubes 5 disposed at the center of the rotary developing unit 2 and then sent to the respective developing devices. The replenishing toner is preliminarily mixed uniformly with a developer already contained in the developing apparatus to provide a prescribed toner concentration by means of mixing-conveying screws in the developing apparatus. At this time, the mixing ratio between the carrier and the toner in the developer is a very important factor from the viewpoint of development effect.

A developer attached onto the surface of a sleeve 13 containing therein a magnet is caused to rub an electrostatic latent image to visualize the latent image with the toner therein. As a result, the toner in the developer is gradually consumed to lower the ratio of the toner to the carrier. Accordingly, the toner is replenished as desired. In this instance, if the toner is replenished exceeding an appropriate level, there arise difficulties that the image density is increased too much and fog is also increased. Accordingly, it is necessary to accurately defect the toner concentration in order to continuously obtain images of a preferable color toner.

Hereinbelow, the present invention is described in more detail with reference to Production Examples and Examples.

PRODUCTION EXAMPLE 1

| | |
|---|---|
| Phenolic resin (condensation product of p-tert-butylphenol and formaldehyde, average molecular weight = 2500, softening point = about 120° C., acid value = about 0 (zero)) | 100 wt. parts |
| Xanthene-type dye (C.I. Solvent Red 49) | 100 wt. parts |

The above materials were melted and melt-kneaded by means of a roll mill. After being cooled, the kneaded product was pulverized into granules of 1 mm or smaller, thereby to obtain a colorant (A).

PRODUCTION EXAMPLE 2

| | |
|---|---|
| Phenolic resin (condensation product of p-phenylphenol and formaldehyde, average molecular weight = 1300, softening point = about 110° C., acid value = about 0 (zero)) | 200 wt. parts |
| Xanthene-type dye (C.I. 45185) | 100 wt. parts |
| Xylene-methyl cellosolve-methyl alcohol (mixing wt. ratio = 50:30:20) | 200 wt. parts |

The above materials were kneaded by means of a kneader, and stretched into a thin sheet thereby to evaporate the solvent. After being cooled, the sheet was then pulverized into granules of 1 mm or smaller, thereby to obtain a colorant (B).

EXAMPLE 1

| | |
|---|---|
| Polyester resin (product synthesized from propoxidized bisphenol A, maleic acid and fumaric acid, softening point = 104° C., acid value = 9, melt viscosity at 88° C. = $10^6$ cp, melt viscosity at 97° C. = $10^5$ cp) | 100 wt. parts |
| The above-mentioned colorant (A) | 0.8 wt. part |
| Quinacridone-type pigment (C.I. Pigment Red 122) | 4.2 wt. parts |
| Negative charge controller (chromium chelate of 3,5-di-tert-butylsalicyclic acid) | 4 wt. parts |

A mixture comprising the above materials was melt-kneaded by means of a roll mill, and after cooling, finely pulverized by means of a jet mill and classified, thereby to obtain a classified product having a volume-average particle size of 8.3 microns.

100 wt. parts of the classified product was mixed with 0.5 wt. part of hydrophobic colloidal silica fine powder treated with hexamethyldisilazane (primary particle size=about 7 um) and 0.2 wt. part of colloidal alumina fine powder (primary particle size= about 20 nm) by means of a Henschel mixer to obtain magenta toner.

4.5 wt. parts of the magenta toner was mixed with 95.5 wt. parts of carrier (Cu-Zn-ferrite powder coated with styrene-acrylic resin, average particle size=48 microns) to obtain a two-component developer having a toner concentration of 4.5%.

The thus obtained two-component developer was subjected to a copying test by using a full-color copying machine (trade name: CLC-1, mfd. by Canon K.K.) comprising a color electrophotographic apparatus including an OPC (organic photoconductor) photosensitive drum as shown in FIG. 1. In this instance, the copying test was conducted so that the peripheral speed of a sleeve for carrying the two component developer was 280 mm/sec.

The thus obtained copied product had a vivid magenta color and had a sufficient image quality with respect to both brightness and saturation. When other color toner images of cyan and yellow were respectively superposed on the magenta image, clear blue and red colors having good saturation were reproduced. When 20,000 sheets of the above-mentioned magenta mono-color copied images were successively provided while replenishing the developer with the toner, dyeing of the silicon rubber fixing roller surface due to the colorant was not observed.

When the thus obtained copied image was superposed on a soft vinyl chloride sheet containing dioctyl phthalate, and the resultant laminate was left standing for two weeks under a condition of 23° C. and 60% RH, and the dye migration was observed, it was found that there was no observable colored matter on the vinyl chloride sheet according to eye observation. When the laminate was further left standing for two weeks under a load of 2 kg/A4 size, the surface of the image was smoothed and the gloss thereof became higher, but there was no image offset or dye migration.

In order to evaluate the light-resistance, the image was subjected to an irradiation test by using a fadeometer (trade name: Super Fadeometer, mfd. by Suga Shikenki K.K.) and artifical light for 40 hours. As a result, no problem was posed with respect to the light-resistance.

When a successive copying test of $1.0\times10^4$ sheets was conducted in the same manner as described above, under a high temperature - high humidity condition (30° C., 80%RH), scattering in the copying machine or ground fog was not observed.

After the copying machine was left standing for 24 hours, the image formation was resumed. As a result, no deterioration in toner scattering or fog was observed, and the image quality, and image quality and image density were well retained as compared with those in the initial stage.

COMPARATIVE EXAMPLE 1

A developer was prepared and the thus obtained developer was subjected to a copying test in the same manner as in Example 1 except for using a xanthene-type dye containing no phenolic resin.

As a result, substantially no change was observed as compared with the images obtained in Example 1 with respect to the resultant color.

When the resultant image was superposed on a soft vinyl chloride sheet for four weeks, and the sheet was placed on white paper, the shape of the image was clearly discernible. However, the copied images were not disturbed nor blurred.

In the successive copying test under a high-humidity condition, scattering or fog was not observed till the copying of 10,000 sheets. However, after the copying machine was left standing for 24 hours, scattering and ground fog were somewhat observed. In this case, after successive copying of 200 to 300 sheets was conducted, the scattering and fog did not substantially occur.

Thereafter, when the standing test was repeated, the scattering and fog were gradually deteriorated.

COMPARATIVE EXAMPLE 2

A magenta toner containing no phenolic resin or quinacridone pigment was prepared and evaluated in the same manner as in Example 1 except for using the following colorant formulation:

| | |
|---|---|
| Anthraquinone dye (C.I. Solvent Red 52) | 1.1 wt. parts |
| Xanthene-type dye (C.I. Solvent Red 49) | 0.5 wt. part |

As a result, in view of the resultant color, somewhat strong bluish light was observed in the resultant images as compared with those obtained in Example 1. However, there was substantially no difference with respect to color reproducibility.

In the successive copying, the fixing roller began to be dyed magenta from the time of 5,000 sheets of copying, and toner offset occurred at the time of 7,000 sheets of copying.

The thus obtained image showed no resistance to a soft vinyl chloride sheet, and clear magenta image migrated to the vinyl chloride sheet after standing of two weeks, whereby white dropouts in the form of spots occurred in the copied image.

Under a high-humidity condition, ground fog was somewhat observed from the initial stage, but marked deterioration was not observed until 10,000 sheets of copying. However, the copying was resumed after standing of 24 hours, reversal development phenomenon occurred.

EXAMPLE 2

| | |
|---|---|
| Unsaturated polyester resin (the same as that used in Example 1) | 100 wt. parts |
| The above-mentioned colorant (B) | 1.0 wt. part |
| Quinacridone-type pigment (C.I. Pigment Red 122) | 4.0 wt. parts |
| Negative charge controller (chromium chelate of 3,5-di-tert-butylsalicyclic acid) | 3 wt. parts |

A classified product having a volume-average particle size of 12.0 microns was prepared in the same manner as in Example 1 by using a mixture comprising the above materials.

100 wt. parts of the classified product was mixed with 0.7 wt. part of colloidal silica fine powder treated with γ-propylaminotrimethoxysilane and amino-modified silicone oil (primary particle size=about 30 nm) by means of a Henschel mixer to obtain magenta toner.

8 wt. parts of the magenta toner was mixed with 92 wt. parts of carrier (Cu-Zn-ferrite powder coated with styrene-acrylic-malamine setting resin, average particle size=50 microns) to obtain a two-component developer having a toner concentration of 8.0%.

The thus obtained two-component developer was subjected to a copying test by using the same copying machine as in Example 1, wherein the peripheral speed of the sleeve was restored to 210 mm/sec.

The thus obtained copied product had a vivid color, but the color was somewhat reddish magenta color as compared with that obtained in Example 1. When another color was superposed on the magenta image, the reproduced color had good saturation but the reproducibility in the reddish side was rather good.

With respect to the durability and resistance to a vinyl chloride sheet, substantially no difference was observed as compared with those obtained in Example 1.

EXAMPLE 3

A classified product was prepared in the same manner as in Example 1 except for using C.I. Pigment Violet 19 instead of the C.I. Pigment Red 122 used in Example 1, and for using the following formulation.

| | |
|---|---|
| Unsaturated polyester resin (the same as that used in Example 1) | 100 wt. parts |
| The above-mentioned colorant (A) | 1.4 wt. part |
| Quinacridone-type pigment (C.I. Pigment Violet 19) | 3.5 wt. parts |
| Negative charge controller (chromium chelate of 3,5-di-tert-butylsalicyclic acid) | 4 wt. parts |

The thus obtained toner had substantially the same performances as those in Example 1 except that the resultant color tone was somewhat bluish.

EXAMPLE 4

| | |
|---|---|
| Unsaturated polyester resin (the same as that used in Example 1) | 60 wt. parts |
| Quinacridone-type pigment (C.I. Pigment Red 122) | 33.6 wt. parts |
| Xanthene-type dye (C.I. Solvent Red 49) | 6.4 wt. parts |
| Condensation product prepared from p-tert-butylphenol and formaldehyde | 9.6 wt. parts |

The above materials were mixed by means of a Henschel mill, and melt-kneaded by means of a roll mill. To the resultant kneaded product, a mixture obtained by mixing the following materials by means of a Henschel mixer was further added.

| | |
|---|---|
| Unsaturated polyester resin (the same as that used in Example 1) | 700 wt. parts |
| Negative charge controller (chromium chelate of 3,5-di-tert-butylsalicyclic acid) | 28 wt. parts |

The resultant kneaded product was cooled, pulverized and classified to obtain a classified product having a volume-average particle size of 8.0 microns.

The resultant color tone was substantially the same as that obtained in Example 1. The copied image slightly migrated to a soft vinyl chloride sheet at the time of standing of four weeks but the migration was not further extended.

EXAMPLE 5

| | |
|---|---|
| Polyester resin (comprising propoxidized bisphenol A, terephthalic acid, trimellitic acid, n-dodecenylsuccinic acid, and polyethylene oxide having a repeating unit of 8; softening point = 110° C., acid value = 10, melt viscosity at 95° C. = $10^6$ cp, melt viscosity at 106° C. = $10^5$ cp) | 100 wt. parts |
| Polypropylene wax | 2 wt. parts |
| Negative charge controller | 4 wt. parts |

-continued

| | |
|---|---|
| (chromium chelate of 3,5-di-tert-butylsalicyclic acid) | |

A mixture comprising the above materials was melt-kneaded by means of a roll mill, and, after cooling, pulverized and classified thereby to obtain a classified product having a volume-average particle size of 5.6 microns.

100 wt. parts of the classified product was mixed with 0.7 wt. part of colloidal silica treated with dimethylsilicone oil (primary particle size=17 nm) and 1.0 wt. part of tin oxide (average particle size=0.5 microns) by means of a Henschel mixer to obtain a magenta toner. 3 wt. parts of the magnetic toner was mixed with 97 wt. parts of carrier coated with fluorine-containing acrylic resin (average particle size=40 microns) to provide a two-component developer having a toner concentration of 3.0%.

When the thus obtained two-component developer was subjected to image formation in the same manner as in Example 1, the resultant light-resistance, anti-dyeing property to a roller were sufficiently satisfactory.

In Examples 6–10 appearing hereinafter, the xanthene-type dye treated with a phenolic resin was one prepared by melt-mixing C.I. Solvent Red 49 and a phenolic resin synthesized from para-tertiary-butylphenol and formaldehyde, by means of a kneader and then pulverizing the kneaded product.

EXAMPLE 6

| | |
|---|---|
| Unsaturated polyester resin | 100 wt. parts |
| Charge controller | 4.0 wt. parts |
| Monoazo-type red pigment (C.I. Pigment Red 122) | 0.5 wt. parts |
| Xanthene-type dye treated with phenolic resin | 4.0 wt. parts |

A mixture comprising the above materials was melt-kneaded by means of a roll mill, and after cooling, finely pulverized by means of a jet mill and classified thereby to obtain a classified product (red color toner) having an average particle size of 8 microns.

99.5 wt. parts of the classified product was mixed with 0.5 wt. part of hydrophobic colloidal silica fine powder (trade name: Aerosil R-972 mfd. by Nihon Aerosil K.K.) by means of a Henschel mixer (external addition) to obtain a red toner containing hydrophobic silica on toner particle surfaces.

6 wt. parts of the red toner was mixed with 94 wt. parts of carrier (ferrite powder coated with resin, average particle size=70 microns) to obtain a two-component developer having a toner concentration of 6%.

The thus obtained two-component developer was subjected to a copying test by using a full-color copying machine (trade name: CLC-1, mfd. by Canon K.K.) comprising a color electrophotographic apparatus including an OPC (organic photoconductor) photosensitive drum as shown in FIG. 1.

The thus obtained toner image had a clear bluish pink color and had a sufficient quality with respect to saturation. When successive copying of 10,000 sheets was conducted by using the copying machine, dyeing of the silicone rubber fixing roller surface due to the xanthene-type dye was not observed.

EXAMPLE 7

| | |
|---|---|
| Styrene-n-butyl methacrylate copolymer | 100 wt. parts |
| Charge controller | 4.0 wt. parts |
| Monoazo-type red pigment (C.I. Pigment Red 122) | 4.0 wt. parts |
| Xanthene-type dye treated with phenolic resin | 2.0 wt. parts |

A red toner having a volume-average particle size of 12 microns was prepared in the same manner as in Example 6 except for using the above-mentioned materials, and the resultant toner was evaluated in the same manner as in Example 1.

As a result, clear red images were provided, and the dyeing of the fixing roller did not occur even under a successive copying test of 10,000 sheets. Further, when the same successive copying test was conducted under a high temperature - high humidity condition (30° C., 80%RH), no fog or scattering was observed even after copying of 5,000 sheets.

EXAMPLE 8

| | |
|---|---|
| Styrene-type resin | 100 wt. parts |
| Charge controller | 4.0 wt. parts |
| Disazo-type yellow pigment (C.I. Pigment Yellow 17) | 4.5 wt. parts |
| Xanthene-type dye treated with phenolic resin | 3.0 wt. parts |

An orange toner having a volume-average particle size of 11 microns was prepared in the same manner as in Example 6 except for using the above-mentioned materials, and the resultant toner was evaluated in the same manner as in Example 6.

As a result, vivid orange toner images were obtained. Further, dyeing of the fixing roller did not occur even under a successive copying test of 15,000 sheets.

COMPARATIVE EXAMPLE 3

| | |
|---|---|
| Unsaturated polyester resin | 100 wt. parts |
| Charge controller | 4.0 wt. parts |
| Xanthene-type dye (C.I. Solvent Red 49) | 4.0 wt. parts |

A toner was prepared in the same manner as in Example 6 except for using the above-mentioned materials, and the resultant toner was evaluated in the same manner as in Example 6.

With respect to the color, the resultant image had a clear bluish pink color. However, in the successive copying using the copying machine, the fixing roller began to be dyed magenta at the time of about 4,000 sheets, and hot offset occurred at the time of 6,000 sheets. When the fixing roller was observed, it was considerably dyed. Further, when the fixing roller was observed with microscope, it was found that the xanthene-type dye considerably penetrated into the interior of the fixing roller.

Further, when the same successive copying test was conducted under a high temperature - high humidity condition (30° C., 80%RH), considerable fog and scattering were observed at the time of 2,000 sheets as compared with those observed in Example 6.

EXAMPLE 9

| | |
|---|---|
| Unsaturated polyester resin | 100 wt. parts |
| Charge controller | 4.0 wt. parts |
| Quinacridon pigment (C.I. Pigment Red 122) | 4.0 wt. parts |
| Xanthene-type dye treated with phenolic resin | 1.0 wt. parts |

A magenta toner was prepared in the same manner as in Example 6 except for using the above materials.

7 wt. parts of the magenta toner was mixed with 93 wt. parts of carrier (ferrite powder coated with styrene-acrylic resin, average particle size=70 microns) to obtain a two-component developer having a toner concentration of 7%.

The thus obtained two-component developer was subjected to a copying test by using a full-color copying machine (trade name: CLC-1, mfd. by Canon K.K.) comprising a color electrophotographic apparatus including an OPC (organic photoconductor) photosensitive drum as shown in FIG. 1.

The thus obtained toner image had a clear magenta color and had a sufficient quality with respect to saturation. When successive copying of 30,000 sheets was conducted by using the copying machine, dyeing of the silicone rubber fixing roller surface due to the xanthene-type dye was not observed.

In order to evaluate the light-resistance of the copied image, the image was subjected to an irradiation test by using a fadeometer (trade name: Super Fadeometer, mfd. by Suga Shikenki K.K.) and artificial light for 60 hours. As a result, fading was somewhat observed at the time of 60 hours, but no change was observed at the time of 40 hours. Accordingly, it was found that practically no problem was posed with respect to the light-resistance.

When a successive copying test of $1.0\times10^4$ sheets was conducted in the same manner as described above, under a high temperature - high humidity condition (30° C., 80%RH), scattering in the copying machine or ground fog was not deteriorated.

EXAMPLE 10

| | |
|---|---|
| Styrene-n-butyl methacrylate copolymer | 100 wt. parts |
| Charge controller | 4.0 wt. parts |
| Quinacridone pigment (C.I. Pigment Red 202) | 4.5 wt. parts |
| Xanthene-type dye treated with phenolic resin | 0.5 wt. parts |

A toner having a volume-average particle size of 12 microns was prepared in the same manner as in Example 6 except for using the above-mentioned materials, and the resultant toner was evaluated in the same manner as in Example 6.

As a result, all of the chromaticity (hue and saturation), light-resistance and anti-dyeing property to a roller were sufficiently satisfactory. Further, even after successive copying of 30,000 sheets, the image was not substantially deteriorated.

COMPARATIVE EXAMPLE 4

| | |
|---|---|
| Styrene-type resin | 100 wt. parts |

-continued

| | |
|---|---|
| Charge controller | 4.0 wt. parts |
| Quinacridone pigment (C.I. Pigment Red 122) | 4.5 wt. parts |

A toner was prepared in the same manner as in Example 6 except for using the above-mentioned materials, and the resultant toner was evaluated in the same manner as in Example 6.

The resultant copied image had a color tone shifted to the reddish side, was poor in saturation and considerably turbid, whereby a clear magenta color was not obtained.

COMPARATIVE EXAMPLE 5

| | |
|---|---|
| Unsaturated polyester resin | 100 wt. parts |
| Charge controller | 4.0 wt. parts |
| Thioindigo pigment (C.I. Pigment Red 88) | 6.0 wt. parts |
| Xanthene-type dye (C.I. Basic Violet 10) | 4.5 wt. parts |

A toner was prepared in the same manner as in Example 6 except for using the above-mentioned materials, and the resultant toner was evaluated in the same manner as in Example 6.

With respect to the color, the resultant image had a somewhat turbid magenta color. With respect to light-resistance, the image was faded only at the time of 10 hours by means of a fadeometer, whereby it did not reach commercially acceptable level. In the successive copying using the copying machine, the fixing roller began to be dyed magenta at the time of about 5,000 sheets, and hot offset occurred at the time of 7,000 sheets. When the fixing roller was observed, it was considerably dyed. Further, when the fixing roller was observed with microscope, it was found that the xanthene-type dye considerably penetrated into the interior of the fixing roller.

Further, when the same successive copying test was conducted under a high temperature - high humidity condition (30° C., 80%RH), considerable fog and toner scattering were observed at the time of 1,000 sheets.

EXAMPLE 11

| | |
|---|---|
| Unsaturated polyester resin | 90 wt. parts |
| Phenolic resin comprising a condensation product formed from tert-butylphenol and formaldehyde | 4.0 wt. parts |
| Charge controller | 4.0 wt. parts |
| Quinacridone pigment (C.I. Pigment Red 122) | 4.0 wt. parts |
| Xanthene-type dye (C.I. Solvent Red 49) | 1.0 wt. part |

A magenta toner was prepared in the same manner as in Example 6 except for using the above materials.

5 wt. parts of the magenta toner was mixed with 95 wt. parts of carrier (Cu-Zn-ferrite powder coated with resin, average particle size =48 microns) to obtain a two-component developer having a toner concentration of 5%.

The thus obtained two-component developer was subjected to a copying test by using a full-color copying machine (trade name: CLC-1, mfd. by Canon K.K.) comprising a color electrophotographic apparatus including an OPC (organic photoconductor photosensitive drum as shown in FIG. 1.

The thus obtained copied product had a vivid magenta color and had a sufficient image quality with respect to saturation. When 30,000 sheets of the above-mentioned magenta mono-color copied images were successively provided, dyeing of the silicone rubber fixing roller surface due to the colorant was not observed.

In order to evaluate the light-resistance, the image was subjected to an irradiation test by using a fadeometer (trade name: Super Fadeometer, mfd. by Suga Shikenki K.K.) and artificial light for 40 hours. As a result, no problem was posed with respect to the light-resistance.

When a successive copying test of $2.0\times10^4$ sheets was conducted in the same manner as described above, under a high temperature - high humidity condition (30° C., 80%RH), scattering in the copying machine or ground fog was not deteriorated.

EXAMPLE 12

| | |
|---|---|
| Polyester resin | 100 wt. parts |
| Charge controller | 4.0 wt. parts |
| Quinacridone pigment (C.I. Pigment Red 122) | 4.5 wt. parts |
| Xanthene-type dye (C.I. Pigment Red 49) treated with phenolic resin comprising a condensation product prepared from tert-butylphenol and formaldehyde | 0.5 wt. parts |

A toner having a volume-average particle size of 12 microns was prepared in the same manner as in Example 1 except for using the above-mentioned materials, and the resultant toner was evaluated in the same manner as in Example 1.

As a result, all of the chromaticity (due and saturation), light-resistance and anti-dyeing property to a roller were sufficiently satisfactory. Further, even after successive copying of 30,000 sheets, the image was not substantially deteriorated.

COMPARATIVE EXAMPLE 6

| | |
|---|---|
| Styrene-type resin | 100 wt. parts |
| Charge controller | 4.0 wt. parts |
| Quinacridone pigment (C.I. Pigment Red 122) | 4.5 wt. parts |

A toner was prepared in the same manner as in Example 6 except for using the above-mentioned materials, and the resultant toner was evaluated in the same manner as in Example 6.

The resultant copied image had a color tone shifted to the reddish side, was poor in saturation and considerably turbid, whereby a clear magenta color was not obtained.

COMPARATIVE EXAMPLE 7

| | |
|---|---|
| Unsaturated polyester resin | 100 wt. parts |
| Charge controller | 4.0 wt. parts |
| Thioindigo pigment (C.I. Pigment Red 88) | 6.0 wt. parts |
| Xanthene-type dye (C.I. Basic Violet 10) | 4.5 wt. parts |

A toner was prepared in the same manner as in Example 6 except for using the above-mentioned materials, and the resultant toner was evaluated in the same manner as in Example 6.

With respect to the hue, the resultant image had a somewhat turbid magenta color. With respect to light-resistance, the image was faded only at the time of 10 hours by means of a fadeometer, whereby it did not reach commercially acceptable level. In the successive copying using the copying machine, the fixing roller began to be dyed magenta at the time of about 5,000 q5 sheets, and hot offset occurred at the time of 7,000 sheets. When the fixing roller was observed, it was considerably dyed. Further, when the fixing roller was observed with microscope, it was found that the xanthene-type dye considerably penetrated into the interior of the fixing roller.

Further, when the same successive copying test was conducted under a high temperature - high humidity condition (30° C., 80%RH), fog and scattering were considerably deteriorated at the time of 1,000 sheets.

SYNTHESIS EXAMPLE OF STYRENE-TYPE RESIN

Figure 2:
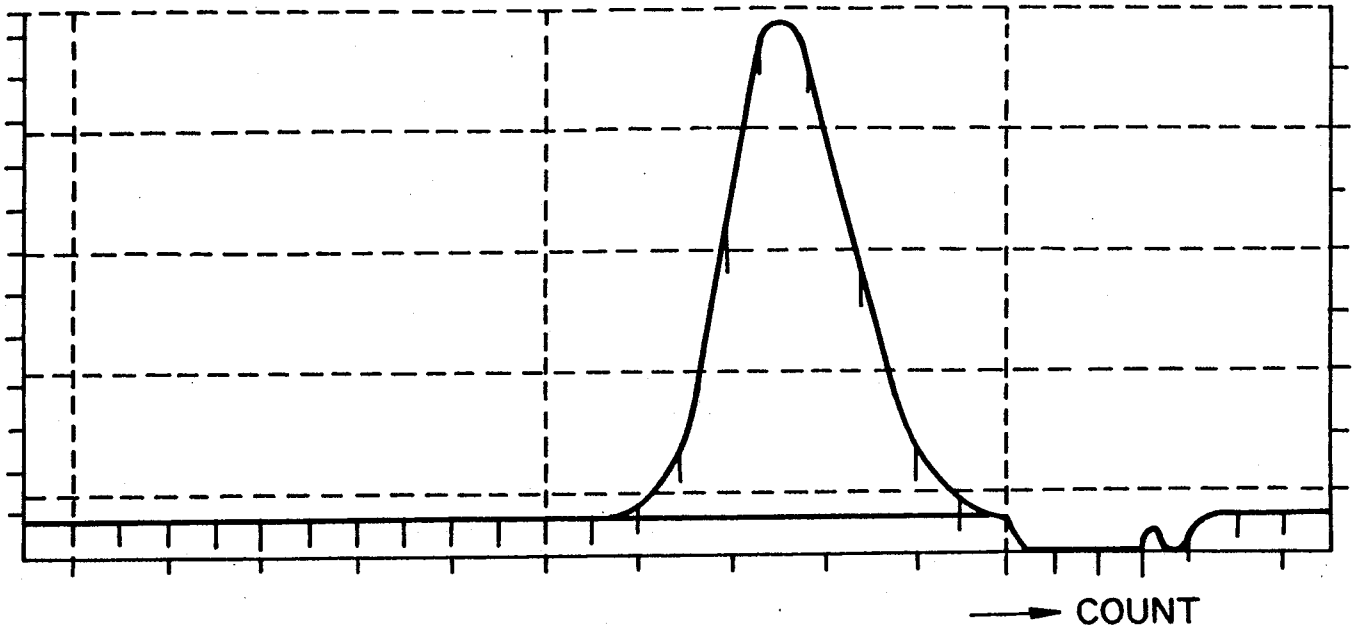
FIG. 2 shows a GPC chart of polymer a obtained in Synthesis Example appearing hereinafter.

Into a reactor, 200 parts by weight of cumene were charged and the temperature was raised to the reflux temperature. To this was added dropwise a mixture comprising styrene monomer, butyl acrylate (wt. ratio=91/9) and 8 wt. parts of di-tert-butylperoxide, under cumene reflux over 4 hours. Further, under cumene reflux, solution polymerization was completed (146° C.-156° C.), and cumene was removed. The thus obtained polymer (Polymer a) was found to be soluble in THF (tetrafluorofuran), with Mw=5,800, Mw/Mn=2.0, and the main peak of GPC was positioned at a molecular weight of 4,500 with Tg=60° C. The GPC chromatogram of the Polymer a is shown in FIG. 2.

The above Polymer a (70 parts by weight) was dissolved in cumeme and subjected to solution polymerization in the same manner as described above together with 30 wt. parts of a monomer mixture comprising styrene and butyl acrylate (78:22) and 1 wt. part of di-tert-butylperoxide, and the cumeme was removed to obtain Resin A.

Figure 3:
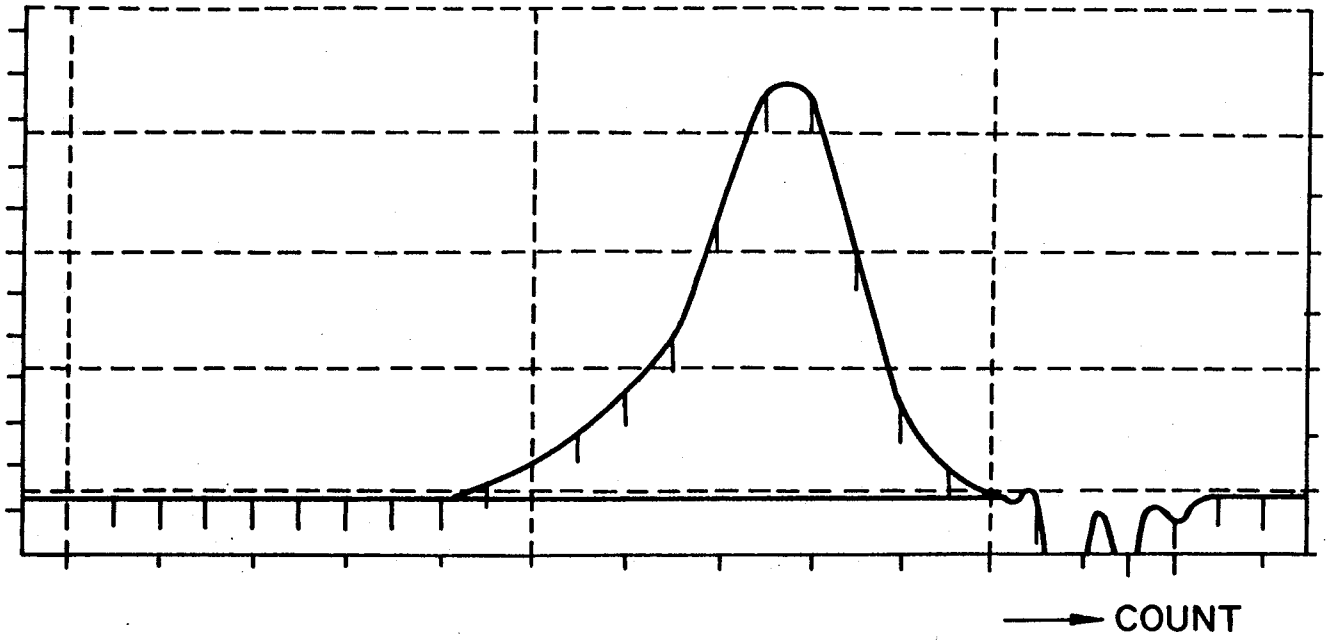

The resin A was found to be soluble in THF, with Mw (weight-average molecular weight)=13,000, Mw/Mn (weight-average molecular weight/number-average molecular weight)=4.4, and the main peak of GPC was positioned at a molecular weight of 5,000 with Tg=59° C. The GPC chromatogram of the Resin A is shown in FIG. 3.

Figure 4:
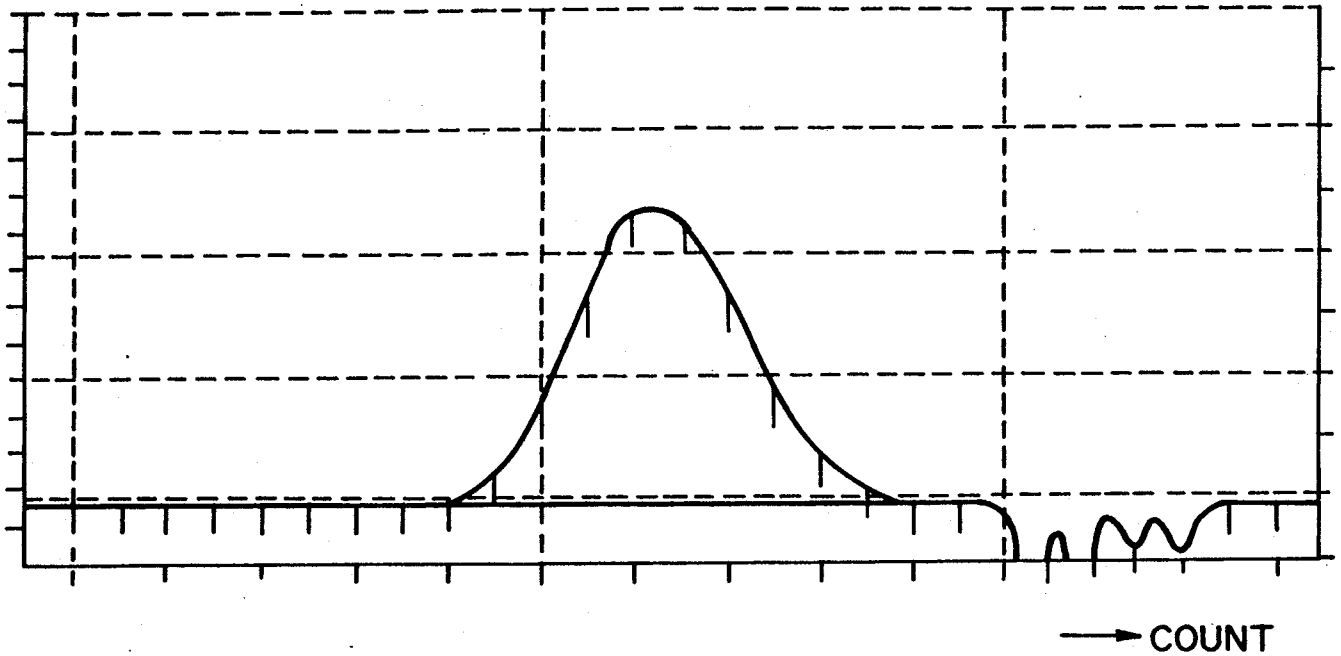

FIG. 4 shows a GPC chromatogram of Resin A which had been prepared in the same manner as described above by using styrene/butyl acrylate monomer mixture containing no polymer a. The Resin A obtained in such a case had Mw of 38,000, Mw/Mn of 2.7, Tg of 59° C., and a main peak at a molecular weight of 27,000 in the GPC chromatogram.

Further, Resins B to G as described below were synthesized by appropriately changing the styrene/acrylic ratio, initiator amount, and polymer amount to be mixed, etc.

Particularly, the Resin E was a polymer obtained by polymerization using a cross-linking agent and about 1 wt. part of benzoyl peroxide as an initiator, and had a gel content insoluble in THF. The gel content used herein was obtained by extracting 0.5 -1.0 g of a resin for 6 hours by means of a Soxhlet extractor, and determining the weight of the dried insoluble.

TABLE 2

| | Resin | Molecular weight distribution (Mw) (%) 50,000 or higher | 50,000 to 10,000 | 10,000 or lower | Gel (%) | Tg (°C.) |
|---|---|---|---|---|---|---|
| Synthesis | A | 12 | 20 | 68 | 0 | 59 |
| Example | B | 5 | 25 | 70 | 0 | 58 |
| | C | 10 | 10 | 80 | 0 | 56 |
| | D | 20 | 25 | 55 | 0 | 61 |
| Comparative | E* | 10 | 45 | 20 | 25 | 62 |
| Synthesis | F | 0 | 10 | 90 | 0 | 52 |
| Example | F | 40 | 20 | 40 | 0 | 65 |

*The THF-soluble other than the gel content was subjected to GPC measurement.

EXAMPLE 13

| | |
|---|---|
| Resin A obtained in Synthesis Example | 100 wt. parts |
| Chromium complex of di-tertiary-butylsalicylic acid | 2.0 wt. parts |
| C.I. Pigment Red 122 | 3.7 wt. parts |
| C.I. Solvent Red 49 treated with phenolic resin (phenolic resin: C.I. Solvent Red 49 = 1:1) | 1.3 wt. parts |

The above materials were melt-kneaded by means of a roll mill, and after cooling, coarsely pulverized, finely pulverized and classified thereby to obtain a classified product having a volume-average particle size of 8.0 microns and containing 32% of particles of 5 microns or smaller and 0% of particles of 20.2 microns or larger.

To 100 wt. parts of the classified product, 0.5 wt. part of silica fine powder treated with hexamethyldisilazane and 0.2 wt. part of aluminum oxide fine powder were externally added as a fluidity improver, thereby to obtain a magenta toner.

The magenta toner was then mixed with carrier to obtain a developer having a toner concentration of 5 wt. %. The carrier used herein was Cu-Zn-Fe ferrite carrier (average particle size=47.2 microns, containing 87 wt. % of particles of 250 mesh-pass and 400 mesh-on) coated with 0.5 wt. % of a styrene-2-ethylhexyl acrylate-methyl methacrylate copolymer (copolymerization wt. ratio=50:20:30).

The thus obtained two-component developer and toner were subjected to an image formation test by using a full-color copying machine (trade name: CLC-1, mfd. by Canon K.K.).

As a result, no offset was observed on the fixing roller even after successive copying of $1.0\times10^4$ sheets in a magenta mono-color mode, and full-color images without fog faithfully reproducing an original color chart were obtained. The conveying property of the toner in the copying machine was good, and stable image density was provided.

In a case where an OHP (overhead projector) film was used, the transparency or light-transmissivity of the toner was excellent. Further, when the image formation test was also conducted under a high temperature - high humidity condition and a low temperature - low humidity condition, good results were obtained such that stable image density was obtained without causing fog, and toner scattering was not substantially observed.

When the images obtained in this instance were exposed to sunlight for three months, the respective colors were not substantially faded and were substantially the same as those immediately after the image formation thereof.

EXAMPLE 14

A classified product having a volume-average particle size of 8.21 microns and containing 30.5% of particles of 5 microns or smaller and 0% of particles of 20.2 microns or larger was prepared in the same manner as in Example 13 except for using 100 wt. parts of Resin B obtained in Synthesis Example. Further, a toner and a developer were prepared in the same manner as in Example 13.

The thus obtained developer and toner were subjected to an image formation test by using a full-color copying machine (trade name: CLC-1, mfd. by Canon K.K.).

As a result, no offset was observed on the fixing roller even after successive copying of $1.2\times10^4$ sheets in a magenta mono-color mode, and full-color images without fog faithfully reproducing an original color chart were obtained. The conveying property of the toner in the copying machine was good, and stable image density was provided.

In a case where an OHP (overhead projector) film was used, the transparency or light-transmissivity of the toner was excellent. Further, when the image formation test was also conducted under a high temperature - high humidity condition and a low temperature - low humidity condition, good results were obtained such that stable image density was obtained without causing fog, and toner scattering was not substantially observed.

When the images obtained in this instance were exposed to sunlight for three months, the respective colors were not substantially faded and were substantially the same as those immediately after the image formation thereof.

EXAMPLE 15

| | |
|---|---|
| Resin C obtained in Synthesis Example | 100 wt. parts |
| C.I. Pigment Violet 19 | 4 wt. parts |
| C.I. Solvent Violet 10 treated with phenolic resin (phenolic resin: C.I. Solvent Violet 10 = 1:1) | 1.5 wt. parts |

A classified product having a volume-average particle size of 7.48 microns and containing 31.0% of particles of 5 microns or smaller and 0% of particles of 20.2 microns or larger was prepared in the same manner as in Example 13 except for using the above-mentioned materials. Further, a toner and a developer were prepared in the same manner as in Example 13.

The thus obtained two-component developer and toner were subjected to an image formation by using a full-color copying machine (trade name: CLC-1, mfd. by Canon K.K.).

As a result, no offset was observed on the fixing roller even after successive copying of $1.1\times10^4$ sheets in a magenta mono-color mode, and full-color images without fog faithfully reproducing an original color chart were obtained. The conveying property of the toner in the copying machine was good and stable image density was provided.

In a case where an OHP (overhead projector) film was used, the transparency or light-transmissivity of the toner was excellent. Further, when the image formation test was also conducted under a high temperature - high humidity condition and a low temperature - low humidity condition, good results were obtained such that stable image density was obtained without causing fog, and toner scattering was not substantially observed.

When the images obtained in this instance were exposed to sunlight for three months, the respective colors were not substantially faded and were substantially the same as those produced by image formation.

EXAMPLE 16

A classified product having a volume-average particle size of 12.5 microns and containing 8% of particles of 5 microns or smaller and 1.2% of particles of 20.2 microns or larger was prepared in the same manner as in Example 13 except for using 100 wt. parts of Resin D obtained in Synthesis Example. Further, a toner and a developer having a toner concentration of 8% were prepared in the same manner as in Example 13, except that aluminum oxide was not used as the fluidity improver.

The thus obtained two-component developer and toner were subjected to an image formation by using a full-color copying machine (trade name: CLC-1, mfd. by Canon K.K.).

As a result, no offset was observed on the fixing roller even after successive copying of $1.3\times10^4$ sheets in a magenta mono-color mode, and full-color images without fog faithfully reproducing an original color chart were obtained. The conveying property of the toner in the copying machine was good, and stable image density was provided.

In a case where an OHP (overhead projector) film was used, the transparency or light-transmissivity of the toner was excellent. Further, when the image formation test was also conducted under a high temperature - high humidity condition and a low temperature - low humidity condition, good results were obtained such that stable image density was obtained without causing fog, and toner scattering was not substantially observed.

When the images obtained in this instance were exposed to sunlight for three months, the respective colors were not substantially faded and were substantially the same as those produced by image formation.

EXAMPLE 17

A classified product having a volume-average particle size of 11.8 microns and containing 7.5% of particles of 5 microns or smaller and 0.5% of particles of 20.2 microns or larger was prepared in the same manner as in Example 13 except for using 3.0 wt. parts of a positive charge controller represented by the above-mentioned formula (II)-1.

To the classified product, 0.5 wt. part of silica treated with an amino group-containing silicone oil (KF-857) was externally added as a fluidity improver, to obtain a magenta toner. Further a developer having a toner concentration of 8% was prepared in the same manner as in Example 16.

The thus obtained two-component developer and toner were subjected to an image formation by using a copying machine (trade name: NP-4835, mfd. by Canon K.K.).

As a result, no offset was observed on the fixing roller even after successive copying of $1.0\times10^4$ sheets in a magenta mono-color mode, and full-color images without fog faithfully reproducing an original color chart were obtained. The conveying property of the toner in the copying machine was good, and stable image density was provided.

In a case were an OHP (overhead projector) film was used, the transparency or light-transmissivity of the toner was excellent. Further, when the image formation test was also conducted under a high temperature - high humidity condition and a low temperature - low humidity condition, good results were obtained such that stable image density was obtained without causing fog, and toner scattering was not substantially observed.

When the images obtained in this instance were exposed to sunlight for three months, the respective colors were not substantially faded and were substantially the same as those immediately afater the image formation thereof.

COMPARATIVE EXAMPLE 8

A classified product having a volume-average particle size of 8.31 microns and containing 29.0% of particles of 5 microns or smaller and 0% of particles of 20.2 microns or smaller was prepared in the same manner as in Example 13 except for using 100 wt. parts of Resin E obtained in Synthesis Example. Further, a toner and a developer were prepared in the same manner as in Example 13.

The thus obtained two-component developer and toner were subjected to an image formation test by using a full-color copying machine (trade name: CLC-1, mfd. by Canon K.K.).

As a result, no offset was observed on the fixing roller even after successive copying of $0.8\times10^4$ sheets in a magenta mono-color mode, but the flatness of the fixed copied image surface was poor. As a result, blurred image having poor color-mixing property were obtained.

COMPARATIVE EXAMPLE 9

A classified product having a volume-average particle size of 8.38 microns and containing 28.0% of particles of 5 microns or smaller and 0% of particles of 20.2 microns or larger was prepared in the same manner as in Example 15 except for using 100 wt. parts of Resin F obtained in Synthesis Example and using C.I. Solvent Violet 10 not being treated with phenolic resin. Further, a toner and a developer were prepared in the same manner as in Example 15.

The thus obtained two-component developer and toner were subjected to an image formation by using a full-color copying machine (trade name: CLC-1, mfd. by Canon K.K.).

As a result, offset was observed on the fixing roller at the time of successive copying of $0.3\times10^4$ sheets in a magenta mono-color mode.

COMPARATIVE EXAMPLE 10

A classified product having a volume-average particle size of 12.2 microns and containing 7.2% of particles of 5 microns or smaller and 1.6% of particles of 20.2 microns or larger was prepared in the same manner as in Example 13 except for using 100 wt. parts of Resin G obtained in Synthesis Example. Further, a toner and a developer were prepared in the same manner as in Example 16.

The thus obtained two-component developer and toner were subjected to an image formation by using a full-color copying machine (trade name: CLC-1, mfd. by Canon K.K.).

As a result, offset toner began to appear on the fixing roller after successive copying of 200 sheets in a magenta mono-color mode, and whole surface offset occurred at the time of successive copying of 300 sheets.

What is claimed is:

1. A color toner for developing an electrostatic latent image, comprising: a binder resin, a xanthene-type dye and a compound containing a phenolic —OH group, said binder resin being selected from the group consisting of vinyl polymer, vinyl copolymer, polyester resin, polyurethane, polyamide, epoxy resin, rosin, modified rosin, terpene resin, aliphatic hydrocarbon resin, alicyclic hydrocarbon resin, aromatic petroleum resin and mixtures thereof, wherein said compound containing a phenolic —OH group is present in an amount of less than 5% by weight based on the total weight of said color toner.

2. A toner according to claim 1, wherein the compound having a phenolic —OH group comprises a phenolic resin.

3. A toner according to claim 1, wherein the binder resin comprises a polyester resin, and the compound having a phenolic —OH group comprises a phenolic resin; said toner further comprising a quinacridone-type pigment.

4. A toner according to claim 3, wherein the xanthene-type dye and the quinacridone-type pigment are contained in an amount of 1—18 wt. parts per 100 wt. parts of the toner.

5. A toner according to claim 3, wherein the xanthene-type dye and the quinacridone-type pigment are contained in an amount of 2–15 wt. parts per 100 wt. parts of the toner.

6. A toner according to claim 3, wherein the xanthene-type dye is contained in an amount of 40 wt. parts or less per 100 wt. parts of the quinacridone-type pigment.

7. A toner according to claim 3, wherein the xanthene-type dye is contained in an amount of 20 wt. parts or less per 100 wt. parts of the quinacridone-type pigment.

8. A toner according to claim 3, wherein the xanthene-type dye is contained in an amount of 1–15 wt. parts per 100 wt. parts of the quinacridone-type pigment.

9. A toner according to claim 2, wherein the phenolic resin is used in an amount of 10 wt. parts or more per 100 wt. parts of the xanthene-type dye, and the amount of the phenolic resin used is below 5 wt. % based on the total weight of the toner.

10. A toner according to claim 9, wherein the amount of the phenolic resin used is 1 wt. % or less based on the total weight of the toner.

11. A toner according to claim 9, wherein the amount of the phenolic resin used is 0.1–0.9 wt. % based on the total weight of the toner.

12. A toner according to claim 2, wherein the xanthene-type dye is preliminarily dispersed in the phenolic resin, and thereafter melt-kneaded together with the binder resin.

13. A toner according to claim 2, wherein the phenolic resin comprises addition condensation product formed by a reaction of a phenolic —OH group-containing compound and an aldehyde group-containing compound or aldehyde group-providing compound; said phenolic —OH group-containing compound being selected from the group consisting of: phenol, cresol, xylenol, catechol, naphthol, alkylphenol and paraphenylphenol; said aldehyde group-containing compound or aldehyde group-providing compound being selected from the group consisting of formaldehyde, acetaldehyde, paraformaldehyde, hexamethylenetetramine, and furfural.

14. A toner according to claim 1, wherein the xanthene-type dye comprises a dye selected from the group consisting of: C.I. 45170:1 (C.I. Solvent Red 49), C.I. 45185, C.I. 45190:1 (C.I. Solvent Violet 10), C.I. 45195, C.I. 45350:1 (C.I. Solvent Yellow 94), C.I. 45365 (C.I. Solvent Orange 32), C.I. 45366 (C.I. Solvent Red 42), C.I. 45370:1 (C.I. Solvent Red 72), C.I. 45371 (C.I. Solvent Orange 18), C.I. 45380:2 (C.I. Solvent Red 43), C.I. 45385 (C.I. Solvent Red 44), C.I. 45386 (C.I. Solvent Red 45), C.I. 45395, C.I. 45396 (C.I. Solvent Orange 16), C.I. 45410 (C.I. Solvent Red 48), C.I. 45415, C.I. 45425:1 (C.I. Solvent Red 73), C.I.45430 (C.I. Solvent Red 140), C.I. 45435:1 (C.I. Solvent Red 47), C.I. 45440:1 (C.I. Solvent Red 141), C.I. 45456 (C.I. Solvent Orange 17), C.I. 45457 (C.I. Solvent Red 46) and C.I. 45550 (C.I. Solvent Green 4).

15. A toner according to claim 1, wherein the xanthene-type dye comprises C.I. 45190:1 (C.I. Solvent Violet 10) or C.I. 45180:1 (C.I. Solvent Red 49).

16. A toner according to claim 3, wherein the quinacridone pigment comprises an organic pigment selected from the group consisting of: C.I. Pigment Red 202, C.I. Pigment Red 209, C.I. Pigment Red 206, C.I. Pigment Red 207, C.I. Pigment Violet 19 and C.I. Pigment Red 122.

17. A toner according to claim 3, wherein the quinacridone pigment comprises C.I. Pigment Red 122.

18. A toner according to claim 3, wherein the quinacridone pigment comprises C.I. Pigment Red 122, and the xanthene-type dye comprises C.I. Solvent Violet 10 or C.I. Solvent Red 49.

19. A toner according to claim 1, wherein the binder resin comprises a styrene-type resin, and the compound having a phenolic —OH group comprises a phenolic resin; said styrene-type resin having a molecular weight distribution based on GPC (gel permeation chromatography) such that there is at least one maximum value (or peak) in the molecular weight range of below 10,000; there is no maximum value in the molecular weight range of 10,000 or higher; an area A corresponding to the molecular weight of below 10,000 in the GPC chromatogram, an area B corresponding to the molecular weight of 10,000–50,000, and an area C corresponding to the molecular weight of above 50,000 respectively have proportions of 55–80%, 5–25% and 2–20%; and Tg (glass transition point) of the styrene resin corresponding to the area A is denoted by Tg(A), and when the Tg of the styrene rein corresponding to the areas B and C is denoted by Tg(B+C), Tg(A) and Tg(B+C) satisfy the following relationships:

70° C.>Tg(A)>50° C., and

65° C.>Tg(B+C)>50° C.

20. A toner according to claim 19, which further comprises a quinacridone pigment.

21. A toner according to claim 20, wherein the xanthene-type dye and the quinacridone-type pigment are contained in an amount of 1–18 wt. parts per 100 wt. parts of the toner.

22. A toner according to claim 20, wherein the xanthene-type dye and the quinacridone-type pigment are contained in an amount of 2–15 wt. parts per 100 wt. parts of the toner.

23. A toner according to claim 20, wherein the xanthene-type dye is contained in an amount of 40 wt. parts or less per 100 wt. parts of the quinacridone-type pigment.

24. A toner according to claim 20, wherein the xanthene-type dye is contained in an amount of 20 wt. parts or less per 100 wt. parts of the quinacridone-type pigment.

25. A toner according to claim 20, wherein the xanthene-type dye is contained in an amount of 1–15 wt. parts per 100 wt. parts of the quinacridone-type pigment.

26. A toner according to claim 19, wherein the phenolic resin is used in an amount of 10 wt. parts or more per 100 wt. parts of the xanthene-type dye and the amount of the phenolic resin used is below 5 wt. % based on the total weight of the toner.

27. A toner according to claim 26, wherein the amount of the phenolic resin used is 1 wt. % or less based on the total weight of the toner.

28. A toner according to claim 26, wherein the amount of the phenolic resin used is 0.1–0.9 wt. % based on the total weight of the toner.

29. A toner according to claim 19, wherein the xanthene-type dye is preliminarily dispersed in the phenolic resin and thereafter melt-kneaded together with the binder resin.

30. A toner according to claim 19, wherein the phenolic resin comprises addition condensation product formed by a reaction of a phenolic —OH group-containing compound and an aldehyde group-containing compound or aldehyde group-providing compound; said phenolic —OH group-containing compound being selected from the group consisting of: phenol, cresol, xylenol, catechol, naphthol, alkylphenol and paraphenylphenol; said aldehyde group-containing compound or aldehyde group-providing compound being selected from the group consisting of formaldehyde, acetaldehyde, paraformaldehyde, hexamethylenetetramine, and furfural.

31. A toner according to claim 19, wherein the xanthene-type dye comprises a dye selected from the group consisting of: C.I. 45170:1 (C.I. Solvent Red 49), C.I. 45185, C.I. 45190:1 (C.I. Solvent Violet 10), C.I. 45195, C.I. 45350:1 (C.I. Solvent Yellow 94), C.I. 45365 (C.I. Solvent Orange 32), C.I. 45366 (C.I. Solvent Red 42), C.I. 45370:1 (C.I. Solvent Red 72), C.I. 45371 (C.I. Solvent Orange 18), C.I. 45380:2 (C.I. Solvent Red 43), C.I. 45385 (C.I. Solvent Red 44), C.I. 45386 (C.I. Solvent Red 45), C.I. 45395, C.I. 45396 (C.I. Solvent Orange 16), C.I. 45410 (C.I. Solvent Red 48), C.I. 45415, C.I. 45425:1 (C.I. Solvent Red 73), C.I.45430 (C.I. Solvent Red 140), C.I. 45435:1 (C.I. Solvent Red 47), C.I. 45440:1 (C.I. Solvent Red 141), C.I. 45456 (C.I. Solvent Orange 17), C.I. 45457 (C.I. Solvent Red 46) and C.I. 45550 (C.I. Solvent Green 4).

32. A toner according to claim 19, wherein the xanthene-type dye comprises C.I. 45190:1 (C.I. Solvent Violet 10) or C.I. 45180:1 (C.I. Solvent Red 49).

33. A toner according to claim 20, wherein the quinacridone pigment comprises an organic pigment selected from the group consisting of: C.I. Pigment Red 202, C.I. Pigment Red 209, C.I. Pigment Red 206, C.I. Pigment Red 207, C.I. Pigment Violet 19 and C.I. Pigment Red 122.

34. A toner according to claim 20, wherein the quinacridone pigment comprises C.I. Pigment Red 122.

35. A toner according to claim 20, wherein the quinacridone pigment comprises C.I. Pigment Red 122, and the xanthene-type dye comprises C.I. Solvent Violet 10 or C.I. Solvent Red 49.

36. A toner according to claim 1, wherein said compound containing a phenolic —OH group is present in an amount of 0.01–20 wt. parts with respect to 100 wt. parts of the binder resin and said xanthene-type dye is present in an amount of 0.01–10 wt. parts with respect to 100 wt. parts of the binder resin.

37. A toner according to claim 1, wherein said compound containing a phenolic —OH group is present in an amount of 0.1–5 wt. parts with respect to 100 wt. parts of the binder resin and said xanthene-type dye is present in an amount of 0.1 to 5 wt. parts with respect to 100 wt. parts of the binder resin.

38. A toner according to claim 1, wherein said binder resin comprises polyester resin.

39. A toner according to claim 38, wherein said compound containing a phenolic —OH group is present in an amount of 0.01–20 wt. parts with respect to 100 wt. parts of the binder resin and said xanthene-type dye is present in an amount of 0.01–10 wt. parts with respect to 100 wt. parts of the binder resin.

40. A toner according to claim 38, wherein said compound containing a phenolic —OH group is present in an amount of 0.1–5 wt. parts with respect to 100 wt. parts of the binder resin and said xanthene type dye is present in an amount of 0.1 to 5 wt. parts with respect to 100 wt. parts of the binder resin.

41. A toner according to claim 38, wherein said binder resin comprises styrene-type resin.

42. A toner according to claim 41, wherein said compound containing a phenolic —OH group is present in an amount of 0.01–20 wt. parts with respect to 100 wt. parts of the binder resin and said xanthene-type dye is present in an amount of 0.01–10 wt. parts with respect to 100 wt. parts of the binder resin.

43. A toner according to claim 41, wherein said compound containing a phenolic —OH group is present in an amount of 0.1–5 wt. parts with respect to 100 wt. parts of the binder resin and said xanthene-type dye is present in an amount of 0.1 to 5 wt. parts with respect to 100 wt. parts of the binder resin.

* * * * *

UNITED STATES PATENT AND TRADEMARK OFFICE

CERTIFICATE OF CORRECTION

PATENT NO. : 5,102,761

DATED : April 7, 1992

INVENTOR(S) : ICHIRO OHSAKI, ET AL.

It is certified that error appears in the above-identified patent and that said Letters Patent is hereby corrected as shown below:

On title page, item

[56] REFERENCES CITED

Under U.S. PATENT DOCUMENTS, insert:

--4,845,002 7/1989 Niki et al. ..... 430/109
4,935,327 6/1990 Takizawa et al. ..... 430/110--.

Insert: -- FOREIGN PATENT DOCUMENT

| | | |
|---|---|---|
| 5957256 | 4/1984 | Japan . |
| 5347174 | 12/1978 | Japan . |
| 57130044 | 8/1982 | Japan . |
| 57130046 | 8/1982 | Japan . |
| 60192957 | 10/1985 | Japan . |
| 59100453 | 6/1984 | Japan . |
| 6066261 | 4/1985 | Japan . |
| 545733 | 1/1979 | Japan . |
| 6215555 | 1/1987 | Japan . |
| 6215556 | 1/1987 | Japan . |
| 6215557 | 1/1987 | Japan . |
| 62280755 | 12/1987 | Japan . |
| 59226358 | 12/1984 | Japan . |
| 61126562 | 6/1986 | Japan . |
| 6230259 | 2/1987 | Japan . |
| 496931 | 1/1974 | Japan . |
| 0274039 | 7/1988 | European Pat. Off. . |
| 3843082 | 7/1989 | Fed. Rep. of Germany . |
| 1286825 | 8/1972 | United Kingdom . |
| 6230259 | 2/1987 | Japan . |
| 49101032 | 9/1974 | Japan . |
| 4825663 | 7/1973 | Japan . --. |

--

UNITED STATES PATENT AND TRADEMARK OFFICE

CERTIFICATE OF CORRECTION

PATENT NO. : 5,102,761

DATED : April 7, 1992

INVENTOR(S) : ICHIRO OHSAKI, ET AL.

It is certified that error appears in the above-identified patent and that said Letters Patent is hereby corrected as shown below:

On title page, item

[56] REFERENCES CITED

Insert: -- OTHER PUBLICATIONS

Patent Abstracts of Japan, Vol. 11, No. 112, April 9, 1987; Patent Abstracts of Japan, Vol. 13, No. 175, April 25, 1989; Patent Abstracts of Japan, Vol. 13, No. 543, December 6, 1989. --.

COLUMN 2

Line 4, "pigments" should read --pigment--.
Line 6, "performances" should read --performance--.
Line 57, "each" should read --for each--.

COLUMN 3

Line 10, "color" (first occurrence) should read --colors--.
Line 40, "kind" should read --kind of--.

COLUMN 5

Line 5, "accoarding" should read --according--.

COLUMN 6

Line 19, "4371" should read --45371--.
Line 35, "wt." should read --wt. parts--.
Line 38, "sate" should read --sate for--.
Line 45, "wt. parts" should read --wt. parts)--.

--

UNITED STATES PATENT AND TRADEMARK OFFICE

CERTIFICATE OF CORRECTION

PATENT NO. : 5,102,761

DATED : April 7, 1992

INVENTOR(S) : ICHIRO OHSAKI, ET AL.

It is certified that error appears in the above-identified patent and that said Letters Patent is hereby corrected as shown below:

COLUMN 7

Line 44, "is" should read --be--.
Line 60, "suppressed," should read --suppressed, when--.

COLUMN 8

Line 35, "be" should be deleted.
Line 52, "is" should read --are--.
Line 63, "(3)" should read --(4)--.

COLUMN 10

Line 55, "a" should read --an--.
Line 66, "substitutent" should read --substituent--.

COLUMN 11

Line 41, "rein" should read --resin--.
Line 50, "first" should read --most--.

COLUMN 12

Line 29, "half-tone" should read --and half-tone--.
Line 56, "lates" should read --lating--.
Line 63, "to" should read --and to--.

COLUMN 13

Line 21, "$2.10^6$" should read --$2\times10^6$--.

--

UNITED STATES PATENT AND TRADEMARK OFFICE

CERTIFICATE OF CORRECTION

PATENT NO. : 5,102,761

DATED : April 7, 1992

INVENTOR(S) : ICHIRO OHSAKI, ET AL.

It is certified that error appears in the above-identified patent and that said Letters Patent is hereby corrected as shown below:

COLUMN 14

Line 11, "methacrlate" should read --methacrylate--.
Line 37, "b9s" should read --bis--.

COLUMN 15

Line 18, "quinacridon" should read --quinacridone--.
Line 29, "1:01" should read --10:1--.

COLUMN 16

Line 23, "$C_4$-$H_9$" should read --$C_4H_9$--.
Line 30, "$C_4$-$H_9$" should read --$C_4H_9$--.

COLUMN 17

Line 5, "is" should read --of--.
Line 34, "such" should read --(such--.
Line 36, "such" should read --(such--.
Line 37, "such" should read --(such--.
Line 60, "microns." should read --micron.--.

COLUMN 18

Line 34, "trimethylchloris-" should read --trimethylchlorosi- --.

COLUMN 19

Line 11, "SI" should read --Si--.
Line 12, "$H_5CH_2$" should read --$H_5C_2$--.
Line 13, "$Ch_2$" should read --$CH_2$--.

--

UNITED STATES PATENT AND TRADEMARK OFFICE

CERTIFICATE OF CORRECTION

PATENT NO. : 5,102,761

DATED : April 7, 1992

INVENTOR(S) : ICHIRO OHSAKI, ET AL.

It is certified that error appears in the above-identified patent and that said Letters Patent is hereby corrected as shown below:

COLUMN 19

Line 19, "$Ch_2$" should read --$CH_2$--.
Line 39, "SI" should read --Si--.

COLUMN 21

Line 26, "with0.01" should read --with 0.01--.
Line 49, "allow image" should read --a low image density and--.
Line 58, "a" should be deleted.

COLUMN 22

Line 16, "drum, 6" should read --drum 6--.
Line 29, "in" should be deleted.

COLUMN 27

Line 14, "microns)" should read --micron)--.
Line 15, "3" should read --¶ 3--.

COLUMN 29

Line 6, "Quinacridon" should read --Quinacridone--.

COLUMN 31

Line 2, "drum" should read --drum)--.
Line 27, "0.5 wt. parts" should read --0.5 wt. part--.
Line 37, "(due" should read --(hue--.

--

UNITED STATES PATENT AND TRADEMARK OFFICE

CERTIFICATE OF CORRECTION

PATENT NO. : 5,102,761

DATED : April 7, 1992

INVENTOR(S) : ICHIRO OHSAKI, ET AL.

It is certified that error appears in the above-identified patent and that said Letters Patent is hereby corrected as shown below:

COLUMN 32

Line 9, "q5" should be deleted.
Line 45, "resin" should read --Resin--.

COLUMN 36

Line 25, "afater" should read --after--.
Line 45, "image" should read --images--.

COLUMN 38

Line 66, "rein" should read --resin--.

COLUMN 40

Line 9, "C.I. 45180:1" should read --C.I. 45170:1--.

Signed and Sealed this

Fifth Day of October, 1993

Bruce Lehman

*Attest:*

BRUCE LEHMAN

*Attesting Officer*

*Commissioner of Patents and Trademarks*